US010360856B2

(12) United States Patent
Oh et al.

(10) Patent No.: US 10,360,856 B2
(45) Date of Patent: Jul. 23, 2019

(54) DISPLAY DEVICE AND DRIVING METHOD THEREOF

(71) Applicant: Samsung Display Co., Ltd., Yongin-si, Gyeonggi-do (KR)

(72) Inventors: Hyun Uk Oh, Yongin-si (KR); Jin Young Jeon, Yongin-si (KR)

(73) Assignee: Samsung Display Co., Ltd. (KR)

( * ) Notice: Subject to any disclaimer, the term of this patent is extended or adjusted under 35 U.S.C. 154(b) by 68 days.

(21) Appl. No.: 15/583,731

(22) Filed: May 1, 2017

(65) Prior Publication Data

US 2017/0316744 A1 Nov. 2, 2017

(30) Foreign Application Priority Data

May 2, 2016 (KR) ..... 10-2016-0054252

(51) Int. Cl.
*G09G 3/3291* (2016.01)
*G09G 3/3266* (2016.01)
(Continued)

(52) U.S. Cl.
CPC ..... *G09G 3/3291* (2013.01); *G09G 3/2007* (2013.01); *G09G 3/3266* (2013.01); *G09G 3/3666* (2013.01); *G09G 2300/0809* (2013.01); *G09G 2300/0819* (2013.01); *G09G 2300/0842* (2013.01); *G09G 2300/0861* (2013.01); *G09G 2310/027* (2013.01); *G09G 2310/0221* (2013.01); *G09G 2310/08* (2013.01); *G09G 2320/0223* (2013.01); *G09G 2320/0233* (2013.01); *G09G 2320/0276* (2013.01);
(Continued)

(58) Field of Classification Search
CPC .. G09G 3/3291; G09G 3/3266; G09G 3/2007; G09G 3/3666; G09G 2330/028; G09G 2300/0842; G09G 2300/0819; G09G 2320/043; G09G 2320/0276; G09G 2310/027; G09G 2300/0861; G09G 2310/0221; G09G 2300/0809; G09G 2320/0233; G09G 2320/0646; G09G 2310/08; G09G 2320/0223
See application file for complete search history.

(56) References Cited

U.S. PATENT DOCUMENTS 8,400,380 B2 3/2013 Lee
10,062,317 B2 * 8/2018 Kim ..... G09G 3/2096
(Continued)

FOREIGN PATENT DOCUMENTS

JP 2004045865 A 2/2004
KR 10-1034690 B1 6/2011
(Continued)

OTHER PUBLICATIONS

European Search Report, Appl. No. 17168863.3, dated Sep. 8, 2017, pp. 1-10.

*Primary Examiner* — Ibrahim A Khan
(74) *Attorney, Agent, or Firm* — Innovation Counsel LLP

(57) ABSTRACT

The present inventive concept relates to a display device improving a bright difference.
An exemplary embodiment of the inventive concept provides a display device, including a panel including a plurality of pixel areas having different widths, and a data driver supplying data signals having different voltages to the plurality of pixel areas in response to a same grayscale.

40 Claims, 15 Drawing Sheets

(51) Int. Cl.
*G09G 3/20* (2006.01)
*G09G 3/36* (2006.01)

(52) U.S. Cl.
CPC ..... *G09G 2320/043* (2013.01); *G09G 2320/0646* (2013.01); *G09G 2330/028* (2013.01)

(56) References Cited

U.S. PATENT DOCUMENTS

2005/0088391 A1* 4/2005 Kim ..... G09G 3/3677 345/94
2005/0207249 A1* 9/2005 Morita ..... G09G 3/3233 365/203
2005/0280624 A1* 12/2005 Liu ..... G09G 3/3611 345/102
2006/0050029 A1 3/2006 Toyoda et al.
2006/0082566 A1 4/2006 Akimoto et al.
2008/0239184 A1* 10/2008 Kim ..... G09G 3/3696 349/41
2010/0060671 A1* 3/2010 Park ..... G09G 3/3413 345/690
2011/0109597 A1* 5/2011 Kim ..... G09G 3/20 345/204
2013/0271515 A1* 10/2013 Lee ..... G09G 3/3291 345/694
2014/0139413 A1* 5/2014 Kwon ..... G09G 3/3208 345/82
2014/0198090 A1* 7/2014 Park ..... G09G 3/3291 345/212
2015/0091953 A1 4/2015 Wu
2015/0348492 A1* 12/2015 Park ..... G09G 3/3666 345/205
2016/0049113 A1 2/2016 Park
2016/0098954 A1 4/2016 Bae
2016/0189631 A1* 6/2016 Kim ..... G09G 3/3225 345/212
2016/0240157 A1* 8/2016 Aoki ..... G09G 3/3666
2016/0267847 A1* 9/2016 Chen ..... G09G 3/3283
2017/0032742 A1* 2/2017 Piper ..... G09G 3/3233
2017/0061840 A1* 3/2017 Ko ..... G09G 3/006
2017/0132963 A1* 5/2017 Zhao ..... G09G 3/3283
2017/0154606 A1* 6/2017 Shin ..... H01L 27/1255
2018/0204889 A1* 7/2018 Yu ..... G09G 3/3233

FOREIGN PATENT DOCUMENTS

KR 10-1322006 B1 10/2013
KR 10-1376654 B1 3/2014
KR 10-2014-0086509 A 7/2014

* cited by examiner

DISPLAY DEVICE AND DRIVING METHOD THEREOF

CROSS-REFERENCE TO RELATED APPLICATION

This application claims priority to, and the benefit of, Korean Patent Application No. 10-2016-0054252 filed on May 2, 2016 in the Korean Intellectual Property Office, the entire contents of which are incorporated herein by reference in their entirety.

BACKGROUND

1. Field

Embodiments of the inventive concept relate to a display device and a driving method thereof, and more particularly, to a display device improving a brightness difference and a driving method thereof.

2. Description of the Related Art

An organic light emitting device may include two electrodes and an organic light emitting layer interposed therebetween. Electrons injected from one of the electrodes may combine with holes injected from the other electrode in the organic light emitting layer to form excitons, and light may be emitted when the excitons discharge energy.

The organic light emitting display device may have a plurality of pixels including organic light emitting diodes that are self-light emitting devices. Wiring lines and a plurality of thin film transistors may be formed in each of the pixels.

The length of each of the wiring lines may vary depending on the number of pixels arranged in a horizontal direction, so that wiring lines may have different load values. When the wiring lines have different load values, a bright difference may occur in the display device due to the difference in load value between the wiring lines.

SUMMARY

Embodiments of the inventive concept provide a display device improving a brightness difference and a driving method thereof.

An exemplary embodiment provides a display device, including a panel including a plurality of pixel areas having different widths; and a data driver supplying data signals having different voltages to the plurality of pixel areas in response to a same grayscale.

The data driver supplies a data signal having a same voltage to the plurality of pixel areas in response to a minimum grayscale.

The data driver may supply a data signal having a lower voltage to a pixel area having a smaller width than a pixel area having a greater width in response to the same grayscale.

At least one predetermined pixel area, among the plurality of pixel areas, may gradually decreases a width from a first width to a second width smaller than the first width.

The predetermined pixel area may have a plurality of regions, each of the plurality of regions including at least one horizontal line, and the data driver supplies data signals having different voltages to the each of the plurality of regions, respectively, in response to the same grayscale.

The data driver may supply a data signal having a lower voltage to a region having a smaller width than a region having a greater width in response to the same grayscale.

The display device may further include a gamma driver supplying different gamma voltages in response to a gamma control signals so that the data signals having the different voltages are supplied to the plurality of pixel areas in response to the same grayscale.

The gamma driver may include a voltage generator generating reference voltages, a first selector selecting one of the reference voltages as a first reference voltage, and a grayscale voltage generator generating the gamma voltages by using the first reference voltage and a second reference voltage supplied externally, the second reference voltage corresponding to a black.

The first selector may select a different voltage, among the reference voltages, as the first reference voltage in each of the plurality of pixel areas.

The first reference voltage may be set to be lower than the second reference voltage.

The grayscale voltage generator may include a first resistor part generating first divided voltages by dividing the first reference voltage and the second reference voltage, a second selector part selecting a third reference voltage and a fourth reference voltage, among the first divided voltages, a second resistor part generating second divided voltages by dividing the second reference voltage and the third reference voltage, a maximum grayscale voltage selector part selecting one of at least one voltage included in the second divided voltages as a maximum grayscale voltage, a reference voltage selector part selecting one of the fourth reference voltage and remaining voltages, except for the at least one voltage, among the second divided voltages, as a fifth reference voltage, a first output part generating predetermined gamma voltages by using the maximum grayscale voltage, the second reference voltage and the fifth reference voltage, and a second output part generating remaining gamma voltages, except for the predetermined gamma voltages, by using the predetermined gamma voltages and the maximum grayscale voltage.

The third reference voltage may be set to be lower than the fourth reference voltage.

The reference voltage selector part may select a different voltage as the fifth reference voltage in each of the plurality of pixel areas.

Another exemplary embodiment provides a display device, including first pixels disposed in a first pixel area having a first width, second pixels having at least a portion disposed in a second pixel area having a second width different from the first width, and drivers driving the first pixels and the second pixels, wherein the drivers supply data signals having different voltages to the first pixels and the second pixels in response to a same grayscale.

The drivers may supply a data signal having a same voltage to the plurality of pixel areas in response to a minimum grayscale.

The second width may be smaller than the first width.

The drivers may supply the second pixels with data signals having a lower voltage than the first pixels in response to the same grayscale.

The display device may further include third pixels disposed in a third pixel area having a third width different from the second width.

The drivers may supply the third pixels with data signals having different voltages from the first pixels and the second pixels in response to the same grayscale.

The third width may be set to be smaller than the second width.

The drivers may supply the third pixels with the data signals having a lower voltage than the second pixels in response to the same grayscale.

The display device may further include third pixels spaced apart from the second pixel area and disposed in a third pixel area having a same width as the second width.

The drivers may supply data signals having a same voltage to the second pixels and the third pixels in response to the same grayscale.

The second pixel area may gradually decrease a width from the first width to the second width.

The second pixel area may have a plurality of regions, each of the plurality of regions including at least one horizontal line, and the drivers supply data signals having different voltages to each of the plurality of regions, respectively, in response to the same grayscale.

The drivers may supply a data signal having a lower voltage to a region having a smaller width than a region having a greater width in response to the same grayscale.

Maximum brightness of each of the first pixels and the second pixels may be limited in response to a plurality of dimming levels.

The drivers may change voltages of data signals of a predetermined grayscale supplied to the first pixels and the second pixels by a first voltage in response to a predetermined dimming level.

The drivers may change the voltages of the data signals of the predetermined grayscale supplied to the first pixels by the first voltage in response to the predetermined dimming level, and the voltages of the data signals of the predetermined grayscale supplied to the second pixels by a second voltage different from the first voltage.

The drivers may include a gamma driver generating gamma voltages, a data driver generating the data signals by using the gamma voltages and supplying the data signals to the first pixels and the second pixels, and a timing controller controlling the data driver and the gamma driver.

The display device may further include a memory storing gamma values corresponding to the first pixel area and the second pixel area, and dimming levels.

The gamma driver may supply different gamma voltages to the first pixels and the second pixels in response to the same grayscale.

The gamma driver may include a voltage generator generating reference voltages, a first selector selecting one of the reference voltages as a first reference voltage, and a grayscale voltage generator generating the gamma voltages by using the first reference voltage and a second reference voltage supplied externally, the second reference voltage corresponding to a black.

The first selector may select a different voltage, among the reference voltages, as the first reference voltage in response to each of the first pixel area and the second pixel area.

The first reference voltage may be set to be lower than the second reference voltage.

The grayscale voltage generator may include a first resistor part generating first divided voltages by dividing the first reference voltage and the second reference voltage, a second selector part selecting a third reference voltage and a fourth reference voltage, among the first divided voltages, a second resistor part generating second divided voltages by dividing the second reference voltage and the third reference voltage, a maximum grayscale voltage selector part selecting one of at least one divided voltage included in the second divided voltages as a maximum grayscale voltage, a reference voltage selector part selecting one of the fourth reference voltage and remaining voltages, except the at least one divided voltage, among the second divided voltages, as a fifth reference voltage, a first output part generating predetermined gamma voltages by using the maximum grayscale voltage, the second reference voltage and the fifth reference voltage, and a second output part generating remaining gamma voltages, except for the predetermined gamma voltages, by using the predetermined gamma voltages and the maximum grayscale voltage.

The third reference voltage may be set to be lower than the fourth reference voltage.

The reference voltage selector part may select a different voltage as the fifth reference voltage in response to each of the first and second pixel areas.

An exemplary embodiment may provide a method of driving a display device having a panel including a plurality of pixel areas having different widths, the method including supplying data signals having different voltages to the plurality of pixel areas in response to a same grayscale.

The method may further include supplying data signals having a same voltage to the plurality of pixel areas in response to a minimum grayscale.

The pixel areas may include a PMOS driving transistor. A data signal having a lower voltage may be supplied to a pixel area having a smaller width than a pixel area having a greater width in response to the same grayscale.

An exemplary embodiment provides a display device, including a display panel including two display areas, the two display areas including a first display area having a first gate line to which a first number of pixels are connected and a second display area having a second gate line to which a second number of pixels are connected, and a data driver supplying data signals having a first voltage to the first display area and a second voltage to the second display area in response to a same grayscale.

The display panel may include a PMOS driving transistor. The first number may be greater than the second number, and the first voltage may be higher than the second voltage.

The second gate line may include a plurality of second gate lines. A number of pixels connected to a second gate line adjacent to the first display area may be greater than a number of pixels connected to a second gate line farther from the first display area, and, in response to the same grayscale, data signals applied to the pixels connected to the gate line adjacent to the first display area may be higher than data signals applied to the pixels connected to the gate line farther from the first display area The display panel may further include a third display area having a third gate line to which a third number of pixels are connected. The third number may be smaller than the second number, and, in response to the same grayscale, the data driver may supply a data signal having a third voltage lower than the second voltage to the third display area. The second display area may include two second display areas, and the two second display areas may be disposed in opposite end of the first display area.

DETAILED DESCRIPTION

Figure 1:
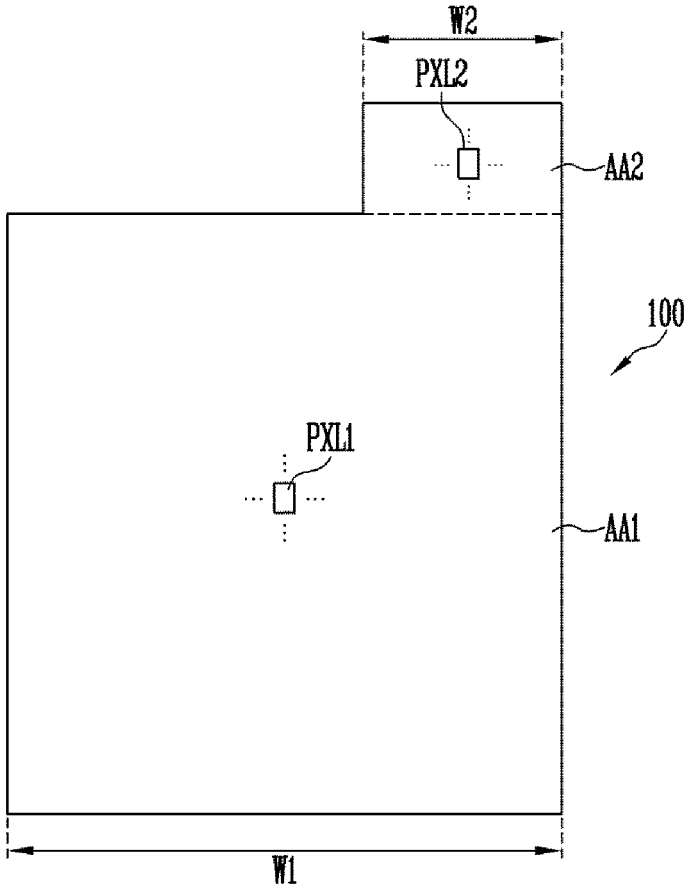
FIG. 1 is a diagram illustrating a substrate according to an embodiment.

While embodiments are described with reference to the accompanying drawings, it is to be understood that various changes and modifications may be made in the inventive concept without departing from the spirit and scope thereof. Further, it should be understood that the inventive concept is not limited to the specific embodiments thereof, and various changes, equivalences and substitutions may be made without departing from the scope and spirit of the inventive concept.

In the present specification, it is to be understood that when one component is referred to as being "connected" or "coupled" to another component, it may be connected or coupled directly to another component or be connected or coupled to another component with one or more other components intervening therebetween. Like reference numerals refer to like elements throughout.

FIG. 1 is a diagram illustrating a substrate 100 according to an embodiment.

Referring to FIG. 1, the substrate 100 (or panel) may include a first pixel area AA1 having a first width W1 and a second pixel area AA2 having a second width W2. The second width W2 may be set to be smaller than the first width W1.

According to an embodiment, a width of a pixel area may be determined by the number of pixels arranged in a horizontal direction of the corresponding pixel area. A horizontal line of the second pixel area AA2 may include a smaller number of pixels than the number of pixels included in a horizontal line of the first pixel area AA1.

First pixels PXL1 may be formed in the first pixel area AA1 having the first width W1. The first pixels PXL1 may display a predetermined image on the first pixel area AA1.

Second pixels PXL2 may be formed in the second pixel area AA2 having the second width W2. The second pixels PXL2 may display a predetermined image on the second pixel area AA2.

The second pixel area AA2 may be disposed at one side of the first pixel area AA1. For example, the second pixel area AA2 may protrude from an upper right portion of the first pixel area AA1.

According to the embodiment, the second pixel area AA2 may have the second width W2 and be formed at various positions so as to be adjacent to the first pixel area AA1.

The substrate 100 may include an insulating material such as glass or resin. In addition, the substrate 100 may include a material having flexibility so that the substrate 100 may be bent or folded. The substrate 100 may include a single layer structure or a multilayer structure.

For example, the substrate 100 may include at least one of polystyrene, polyvinyl alcohol, polymethyl methacrylate, polyethersulfone, polyacrylate, polyetherimide, polyethylene naphthalate, polyethylene terephthalate, polyphenylene sulfide, polyarylate, polyimide, polycarbonate, triacetate cellulose, and cellulose acetate propionate.

However, the substrate 100 may include various other materials in addition to the above materials. For example, the substrate 100 may include fiber glass reinforced plastic (FRP).

Figure 2:
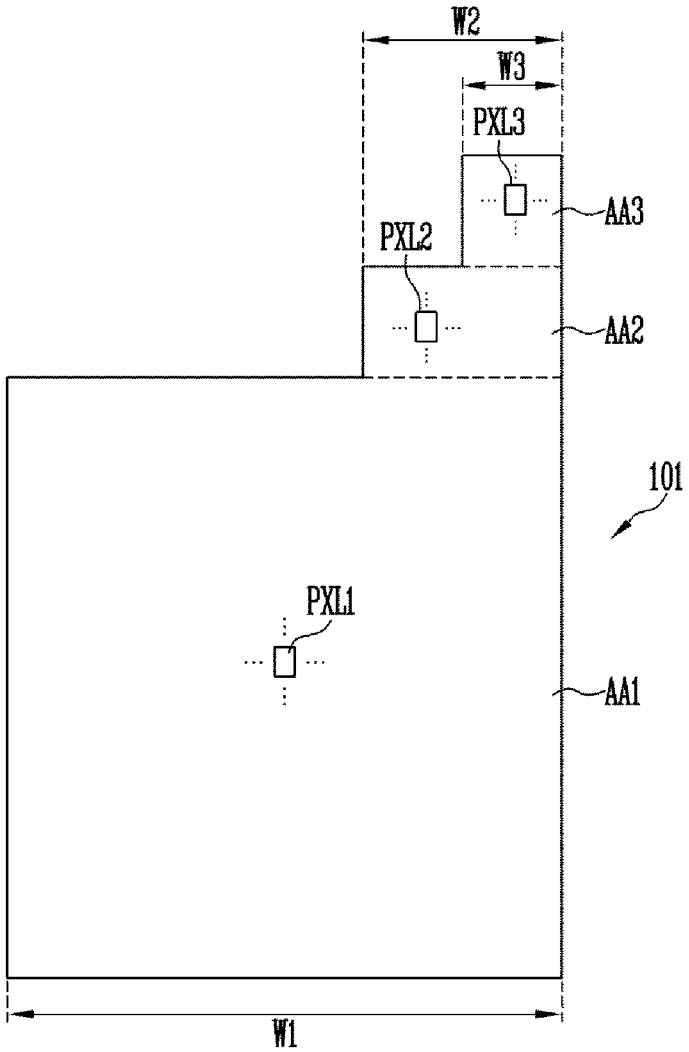
FIG. 2 is a diagram illustrating a substrate according to another embodiment.

FIG. 2 is a diagram illustrating a substrate 101 according to another embodiment.

Referring to FIG. 2, the substrate 101 may include a first pixel area AA1 having a first width W1, a second pixel area AA2 having a second width W2, and a third pixel area AA3 having a third width W3. The third width W3 may be set to be smaller than the second width W2, and the second width W2 may be set to be smaller than the first width W1.

The first pixels PXL1 may be formed in the first pixel area AA1 having the first width W1. The first pixels PXL1 may display a predetermined image on the first pixel area AA1.

The second pixels PXL2 may be formed in the second pixel area AA2 having the second width W2. The second pixels PXL2 may display a predetermined image on the second pixel area AA2.

Third pixels PXL3 may be formed in the third pixel area AA3 having the third width W3. The third pixels PXL3 may display a predetermined image on the third pixel area AA3.

The second pixel area AA2 may be disposed at one side of the first pixel area AA1. For example, the second pixel area AA2 may protrude from an upper right portion of the first pixel area AA1. In addition, the second pixel area AA2 may have the second width W2 and be formed at various locations so as to be adjacent to the first pixel area AA1.

The third pixel area AA3 may be disposed at one side of the second pixel area AA2. For example, the third pixel area AA3 may protrude from an upper right portion of the second pixel area AA2. In addition, the third pixel area AA3 may have the third width W3 and be formed at various positions so as to be adjacent to the first pixel area AA1 or the second pixel area AA2.

Figure 3:
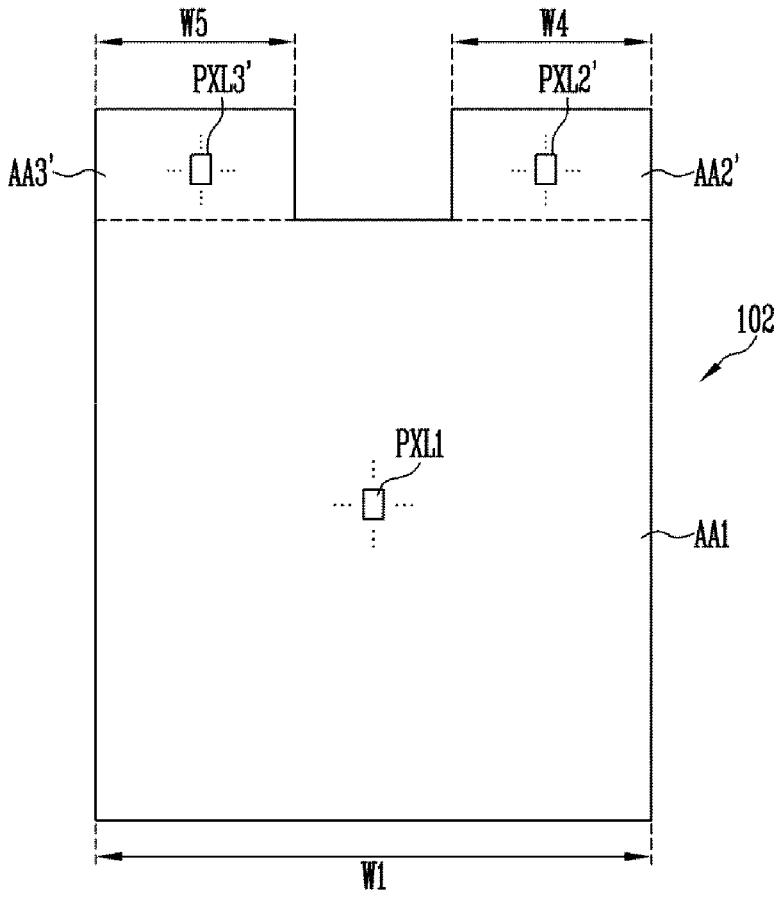
FIG. 3 is a diagram illustrating a substrate according to another embodiment.

FIG. 3 is a diagram illustrating a substrate 102 according to another embodiment.

Referring to FIG. 3, the substrate 102 may include the first pixel area AA1 having the first width W1, a second pixel area AA2' having a fourth width W4, and a third pixel area AA3' having a fifth width W5. Each of the fourth width W4 and the fifth width W5 may be set to be smaller than the first width W1. The fourth width W4 and the fifth width W5 may be the same or different from each other.

The first pixels PXL1 may be formed in the first pixel area AA1 having the first width W1. The first pixels PXL1 may display a predetermined image on the first pixel area AA1.

Second pixels PXL2' may be formed in the second pixel area AA2' having the fourth width W4. The second pixels PXL2' may display a predetermined image on the second pixel area AA2'.

Third pixels PXL3' may be formed in the third pixel area AA3' having the fifth width W5. The third pixels PXL3' may display a predetermined image on the third pixel area AA3'.

The second pixel area AA2' and the third pixel area AA3' may be disposed at one side of the first pixel area AA1. For example, the second pixel area AA2' may protrude from an upper right portion of the first pixel area AA1 and the third pixel area AA3' may protrude from an upper left portion of the first pixel area AA1. In addition, the second pixel area AA2' and the third pixel area AA3' may have the fourth width W4 and the fifth width W5, respectively, and be formed at various locations so as to be adjacent to the first pixel area AA1.

Figure 4:
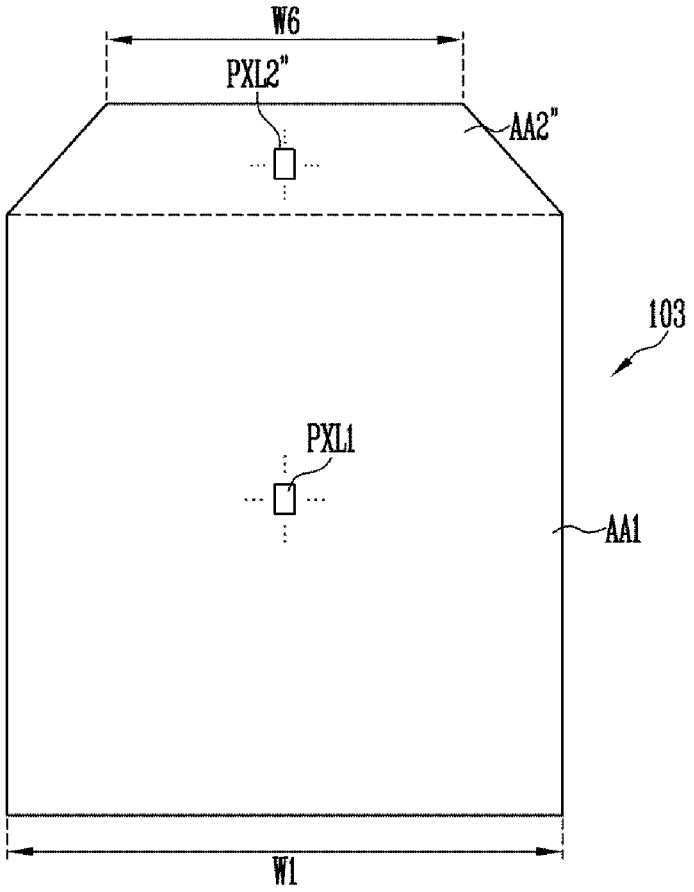
FIG. 4 is a diagram illustrating a substrate according to another embodiment.

FIG. 4 is a diagram illustrating a substrate 103 according to another embodiment.

Referring to FIG. 4, the substrate 103 may include the first pixel area AA1 having the first width W1 and a second pixel area AA2". At least a portion of the second pixel area AA2" may have a sixth width W6. The sixth width W6 may be set to be smaller than the first width W1.

The first pixels PXL1 may be formed in the first pixel area AA1 having the first width W1. The first pixels PXL1 may display a predetermined image on the first pixel area AA1.

The second pixel area AA2" may be set to have a width gradually decrease from the first width W1 to the sixth width W6. The second pixel area AA2" adjacent to the first pixel area AA1 may have the first width W1 and the opposing end of the second pixel area AA2" may have the sixth width W6. The number of second pixels PXL2" formed in a same horizontal line (row) in the second pixel area AA2" may vary. For example, more second pixels PXL2" may be arranged in a horizontal line which is disposed closer to the first pixel area AA1 than second pixels PXL2" disposed farther from the first pixel area AA1.

The second pixel area AA2" may be arranged above the first pixel area AA1. In addition, according to an embodiment, the second pixel area AA2" may be disposed below the first pixel area AA1, or both above and below the first pixel area AA1.

The first to sixth widths W1 to W6 used to describe FIGS. 1 to 4 may vary depending on the size of the substrate. In addition, each of the fourth width W4, the fifth width W5 and the sixth width W6 may be set to be the same or different from the second width W2 or the third width W3.

Figure 5:
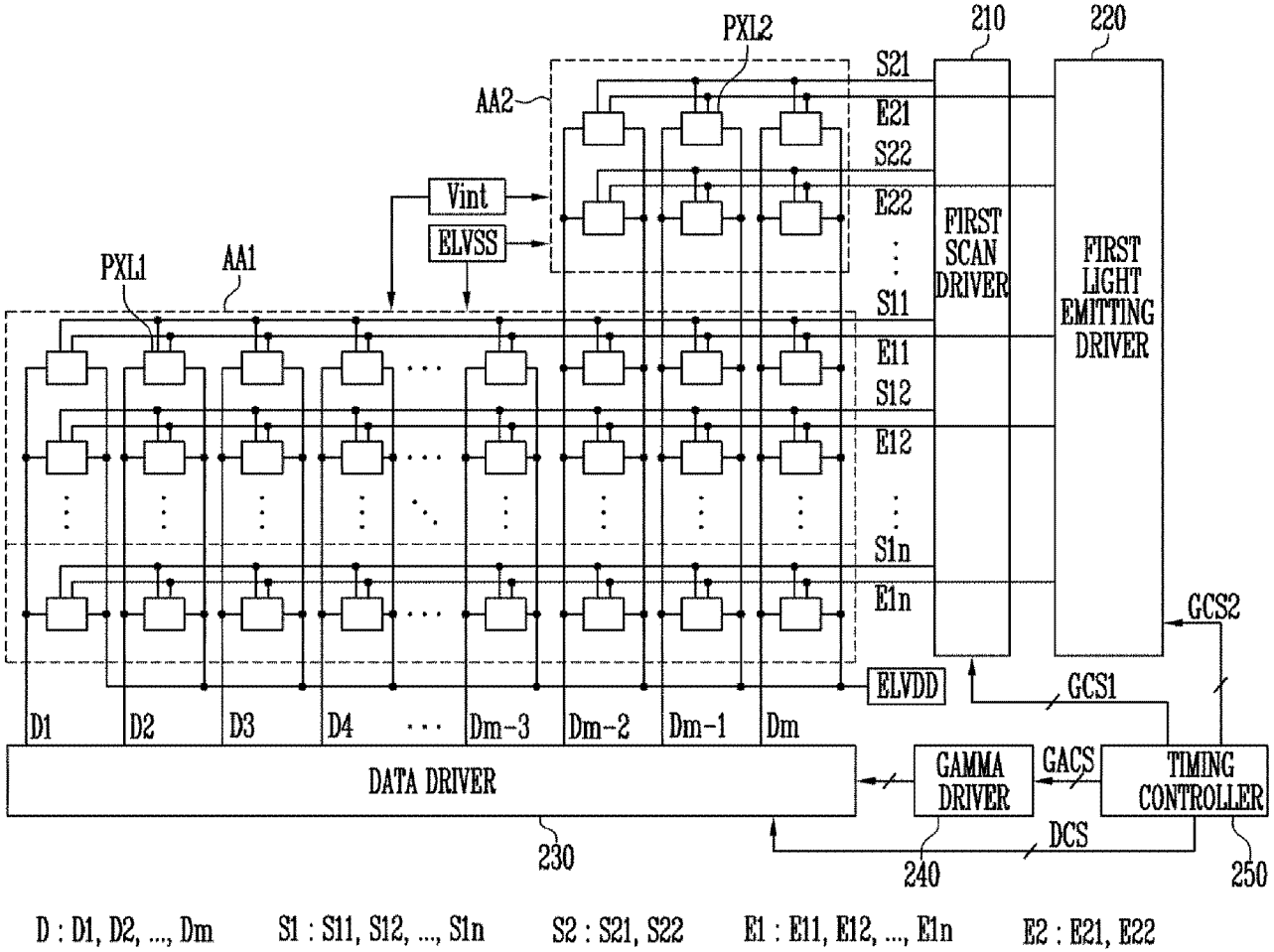
FIG. 5 is a diagram illustrating an embodiment of an organic light emitting display device corresponding to a substrate shown in FIG. 1.

FIG. 5 is a diagram illustrating an embodiment of an organic light emitting display device corresponding to a substrate shown in FIG. 1.

Referring to FIG. 5, an organic light emitting display device according to an embodiment may include a first scan driver 210, a first light-emitting driver 220, a data driver 230, a gamma driver 240, a timing controller 250, the first pixels PXL1 and the second pixels PXL2.

The first pixels PXL1 may be disposed in the first pixel area AA1 defined by first scan lines S11 to S1*n*, first light emission control lines E11 to E1*n* and data lines D1 to Dm. The first pixels PXL1 may receive data signals from the data lines D1 to Dm when scan signals are supplied from the first scan lines S11 to S1*n*. The first pixels PXL1 receiving the data signals may control the amount of current flowing from a first power supply ELVDD to a second power supply ELVSS through organic light emitting diodes illustrated in FIG. 9.

The second pixels PXL2 may be disposed in the second pixel area AA2 defined by second scan lines S21 and S22, second light emission control lines E21 and E22 and data lines Dm-2 to Dm. The second pixels PXL2 may receive data signals from data lines Dm-2 to Dm when scan signals are supplied from the second scan lines S21 and S22. The second pixels PXL2 receiving the data signals may control the amount of current flowing from the first power supply ELVDD to the second power supply ELVSS through organic light emitting diodes.

FIG. 5 illustrates that six second pixels PXL2 are arranged in the second pixel area AA2 by the two second scan lines S21 and S22, the two second light emission control lines E21 and E22 and the three data lines Dm-2 to Dm. However, the inventive concept is not limited thereto. In other words, the plurality of second pixels PXL2 may be arranged according to the size of the second pixel area AA2. The numbers of second scan lines S2, second light emission control lines E2 and data lines D may vary depending on a configuration of the second pixels PXL2, for example, the number of the second scan lines, second light emission control lines and data lines in the second pixel area AA2.

The first scan driver 210 may supply scan signals to the second scan lines S2 and the first scan lines S1 in response to a first gate control signal GCS1 from the timing controller 250. For example, the first scan driver 210 may sequentially supply scan signals to the second scan lines S2 and the first scan lines S1. When the scan signals are sequentially supplied to the second scan lines S2 and the first scan lines S1, the second pixels PXL2 and the first pixels PXL1 may be sequentially selected in a unit of horizontal line.

The first scan driver 210 may be formed on the substrate 100 by a thin film process. In addition, the first scan driver 210 may be formed at both sides of the substrate while interposing the first pixel area AA1 and the second pixel area AA2 therebetween. In addition, the first pixel area AA1 and the second pixel area AA2 may be driven by different scan drivers.

The first light-emitting driver 220 may supply light emission control signals to the second light emission control lines E2 and the first light emission control lines E1 in response to a second gate control signal GCS2 from the timing controller 250. For example, the first light-emitting driver 220 may sequentially supply the light emission control signals to the second light emission control lines E2 and the first light emission control lines E1. The light emission control signals may be applied to control light emission periods of pixels PXL. The light emission control signal may be set to have a greater width than the scan signal.

The first light-emitting driver 220 may be formed on the substrate 100 by a thin film process. In addition, the first light-emitting driver 220 may be formed at both sides of the substrate while interposing the first pixel area AA1 and the second pixel area AA2 therebetween. In addition, the first pixel area AA1 and the second pixel area AA2 may be driven by different light-emitting drivers.

The data driver 230 may supply data signals to the data lines D1 to Dm in response to a data control signal DCS from the timing controller 250. The data signals supplied to the data lines D1 to Dm may be supplied to the pixels PXL1 and PXL2 selected by the scan signals. It is illustrated that the data driver 230 is arranged at the bottom of the first pixel area AA1. However, the inventive concept is not limited thereto. For example, the data driver 230 may be arranged at the top of the first pixel area AA1.

The data driver 230 may supply data signals having different voltages to the first pixels PXL1 and the second pixels PXL2 in response to the same grayscale, except for the first grayscale, so as to compensate for a brightness difference. The first grayscale may be selected as the lowest grayscale, e.g., a black grayscale.

More specifically, the first pixels PXL1 may be disposed in the first pixel area AA1 having the first width W1 and the second pixels PXL2 may be disposed in the second pixel area AA2 having the second width W2.

Figure 6:
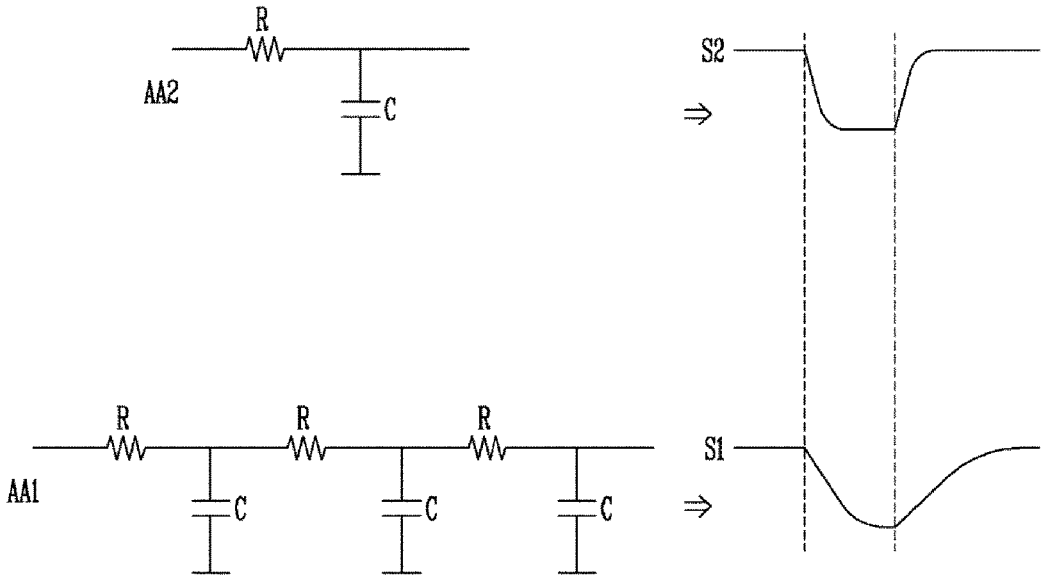
FIG. 6 is a diagram illustrating an RC load value according to each pixel area shown in FIG. 5.

As shown in FIG. 6, an RC load of the first scan lines S1 disposed in the first pixel area AA1 may be greater than an RC load of the second scan lines S2 disposed in the second pixel area AA2. Therefore, the scan signal supplied to the first scan line S1 may have a greater delay than the scan signal supplied to the second scan line S2 due to a difference in RC delays.

Therefore, when data signals having the same voltage are supplied, a first voltage may be stored in the first pixels PXL1, and a second voltage greater than the first voltage may be stored in the second pixels PXL2. Although data signals of the same grayscale are supplied, a brightness difference may occur between the first pixel area AA1 and the second pixel area AA2 due to a difference in the stored voltages in the first pixels PXL1 and the second pixels PXL2. For example, when the pixels PXL1 and PXL2 are PMOS pixels, a darker screen may be displayed on the second pixel area AA2 than the first pixel area AA1 in response to the data signals of the same grayscale.

To compensate for the brightness difference, the data driver 230 may supply data signals of different voltages to the first pixels PXL1 and the second pixels PXL2 in response to the same grayscale except for the lowest grayscale, e.g., a black grayscale. In other words, the data driver 230 may supply data signals having a lower voltage than the first pixels PXL1 to the second pixels PXL2 in response to the same grayscale except for the lowest grayscale, e.g., a black grayscale. When the data signals having a lower voltage than the first pixels PXL1 are supplied to the second pixels PXL2 disposed in the second pixel area AA2, the brightness of the second pixels PXL2 may increase, so that the brightness difference between the second pixel area AA2 and the first pixel area AA1 may be compensated.

In addition, considering the second width W2 of the second pixel area AA2, the voltages of the data signals supplied to the second pixels PXL2 may be experimentally determined so as not to cause, or minimize the brightness difference between the first pixels PXL1 and the second pixel area AA2.

The gamma driver 240 may supply gamma voltages to the data driver 230 in response to gamma control signals GACS from the timing controller 250.

The gamma driver 240 may supply different gamma voltages to the first pixels PXL1 and the second pixels PXL2, respectively, to compensate for the brightness difference. For example, the gamma driver 240 may supply first gamma voltages to the first pixels PXL1 and second gamma voltages lower than the first gamma voltages to the second pixels PXL2.

The timing controller 250 may supply the first gate control signals GCS1 generated based on externally supplied timing signals to the first scan driver 210, the second gate control signals GCS2 to the first light-emitting driver 220, and the gamma control signals GACS to the gamma driver 240, and the data control signals DCS to the data driver 230.

Each of the gate control signals GCS1 and GCS2 may include a start pulse and clock signals. The start pulse may be used to control timing of the first scan signal or the first light emission control signal. The clock signals may be used to shift the start pulse.

The data control signals DCS may include a source start pulse and clock signals. A source start pulse may be used to control a sampling start point of data. The clock signals may be used to control a sampling operation.

The gamma control signals GACS may include control signals to select the gamma voltages.

Figure 7:
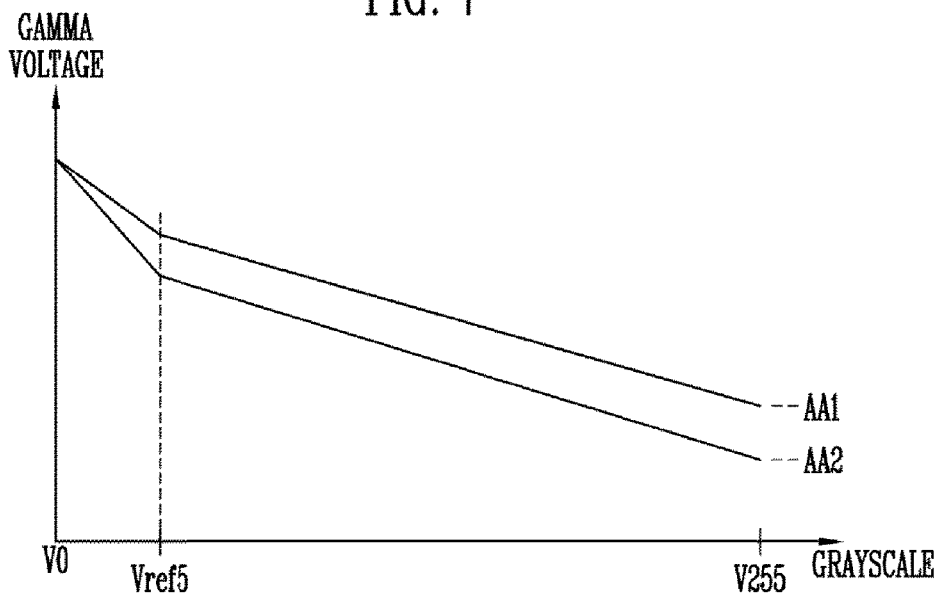
FIG. 7 is a diagram illustrating an embodiment of gamma voltages supplied to each of the pixel areas shown in FIG. 5.

FIG. 7 is a diagram illustrating an embodiment of gamma voltages supplied according to pixel areas shown in FIG. 5. For convenience of explanation, in FIG. 7, it is assumed that an organic light emitting display device is driven by 256 levels of grayscale.

Referring to FIG. 7, the gamma driver 240 may supply 256 gamma voltages V0 to V255 corresponding to the 256 levels of grayscale to the data driver 230.

The gamma voltages supplied to the first pixels PXL1 (i.e., first pixel area AA1) in response to the same grayscale may be set to be greater than those supplied to the second pixels PXL2 (i.e., second pixel area AA2) except for the lowest grayscale, e.g., a black grayscale. Thus, the brightness difference between the first pixel area AA1 and the second pixel area AA2 may be compensated to display an image with uniform brightness in response to the same grayscale.

Figure 8:
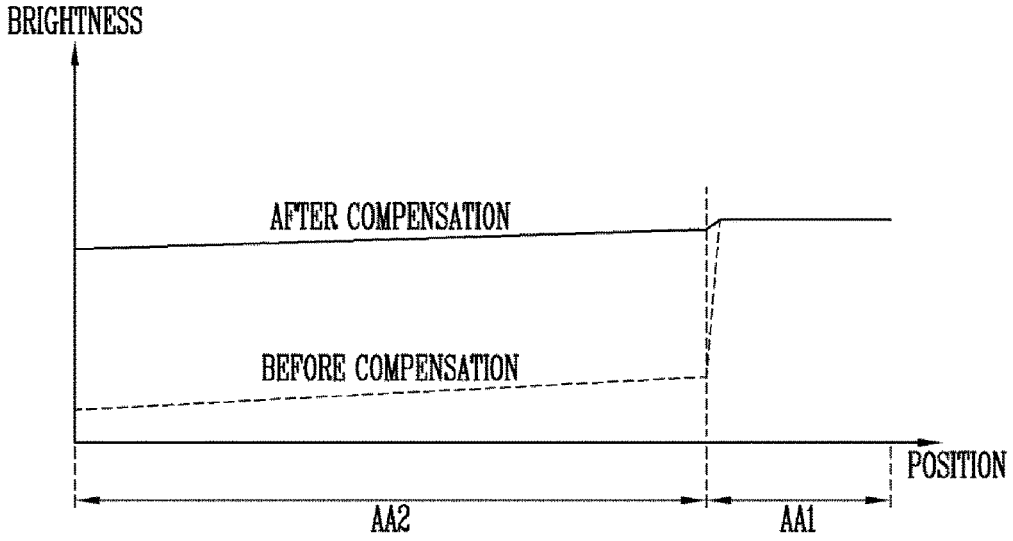
FIG. 8 is a diagram illustrating brightness of an image displayed on each of the pixel areas shown in FIG. 5.

For example, as shown in FIG. 8, when the same data signals (the same gamma voltages) are supplied to the first pixel area AA1 and the second pixel area AA2, a brightness difference may occur between the first pixel area AA1 and the second pixel area AA2 due to a difference in RC delays. On the other hand, when lower data signals than the first pixel area AA1 are supplied to the second pixel area AA2 in response to the same grayscale as in the inventive concept, the brightness difference between the first pixel area AA1 and the second pixel area AA2 may be minimized to display a uniform image.

When the pixels PXL1 and PXL2 display black, a brightness difference may not occur between the pixel areas AA1 and AA2. In addition, since the gamma voltage V0 corresponding to black, the same voltage may be set regardless of the difference in the RC delays in the first pixel area AA1 and the second pixel area AA2. Therefore, the gamma driver 240 may supply the same gamma voltage V0 corresponding to the black to the first pixel area AA1 and the second pixel area AA2. The data signals corresponding to black supplied from the data driver 230 may be set to be the same as each other with respect to the first pixels PXL1 and the second pixels PXL2.

Figure 9:
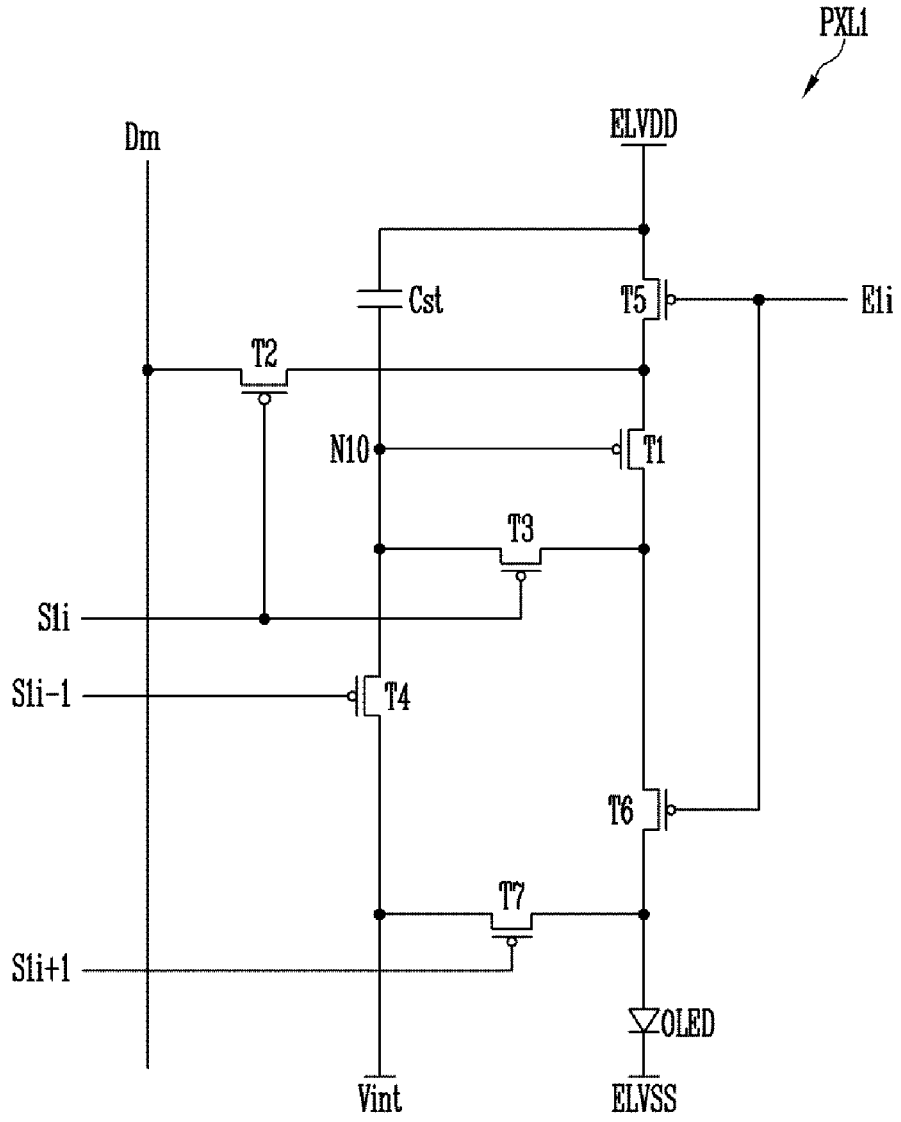
FIG. 9 is a diagram illustrating an embodiment of a first pixel shown in FIG. 5.

FIG. 9 is a diagram illustrating an embodiment of a first pixel shown in FIG. 5. For convenience of explanation, FIG. 9 illustrates a pixel connected to an mth data line Dm and an ith first scan line S1*i*, where i is a natural number.

Referring to FIG. 9, the first pixel PXL1 according to an embodiment may include an organic light emitting diode OLED, first to seventh transistors T1 to T7, and a storage capacitor Cst.

An anode electrode of the organic light emitting diode OLED may be connected to the first transistor T1 via the sixth transistor T6, and a cathode electrode thereof may be connected to the second power supply ELVSS. The organic light emitting diode OLED may generate light with predetermined brightness in response to the amount of current supplied from the first transistor T1 to the organic light emitting diode OLED.

The first power supply ELVDD may be set to a greater voltage than the second power supply ELVSS so that current may flow through the organic light emitting diode OLED.

The seventh transistor T7 may be connected between an initialization power supply Vint and the anode electrode of the organic light emitting diode OLED. In addition, a gate electrode of the seventh transistor T7 may be connected to an (i+1)th first scan line S1*i*+1. When a scan signal is supplied to the (i+1)th first scan line S1*i*+1, the seventh transistor T7 may be turned on to supply the voltage of the initialization power supply Vint to the anode electrode of the organic light emitting diode OLED. The initialization power supply Vint may be set to a lower voltage than a data signal.

The sixth transistor T6 may be connected between the first transistor T1 and the organic light emitting diode OLED. In addition, a gate electrode of the sixth transistor T6 may be coupled to the ith first light emission control line E1*i*. The sixth transistor T6 may be turned off when a light emission control signal is supplied to the ith first light emission control line E1*i*, and turned on during the remaining period.

The fifth transistor T5 may be coupled between the first power supply ELVDD and the first transistor T1. In addition, a gate electrode of the fifth transistor T5 may be coupled to the ith first light emission control line E1*i*. The fifth transistor T5 may be turned off when a light emission control signal is supplied to the ith first light emission control line E1*i*, and turned on during the remaining period.

A first electrode of the first transistor T1 (driving transistor) may be coupled to the first power supply ELVDD via the fifth transistor T5, and a second electrode thereof may be coupled to the anode electrode of the organic light emitting diode OLED via the sixth transistor T6. In addition, a gate electrode of the first transistor T1 may be connected to a tenth node N10. The first transistor T1 may control the amount of current flowing from the first power supply ELVDD via the organic light emitting diode OLED to the second power supply ELVSS in response to a voltage of the tenth node N10.

The third transistor T3 may be connected between the second electrode of the first transistor T1 and the tenth node N10. In addition, a gate electrode of the third transistor T3 may be connected to the ith first scan line S1*i*. When a scan signal is supplied to the ith first scan line S1*i*, the third transistor T3 may be turned on to electrically connect the second electrode of the first transistor T1 to the tenth node N10. Therefore, when the third transistor T3 is turned on, the first transistor T1 may be connected as a diode.

The fourth transistor T4 may be connected between the tenth node N10 and the initialization power supply Vint. In addition, a gate electrode of the fourth transistor T4 may be connected to an (i−1)th first scan line S1*i*−1. When a scan signal is supplied to the (i−1)th first scan line S1*i*−1, the fourth transistor T4 may be turned on to supply the voltage of the initialization power supply Vint to the tenth node N10.

The second transistor T2 may be connected between the mth data line Dm and the first electrode of the first transistor T1. In addition, a gate electrode of the second transistor T2 may be coupled to the ith first scan line S1*i*. When a scan signal is supplied to the ith first scan line S1*i*, the second transistor T2 may be turned on to electrically connect the mth data line Dm to the first electrode of the first transistor T1.

The storage capacitor Cst may be connected between the first power supply ELVDD and the tenth node N10. The storage capacitor Cst may store the data signal and a voltage corresponding to a threshold voltage of the first transistor T1.

The second pixel PXL2 may have substantially the same circuit as the first pixel PXL1. Therefore, a detailed description of the second pixel PXL2 will be omitted. In addition, according to an embodiment, the first pixel PXL1 and the second pixel PXL2 may include the same or different circuits. Various types of currently known circuits may be used to form the first and second pixels PXL1 and PXL2.

Figure 10:
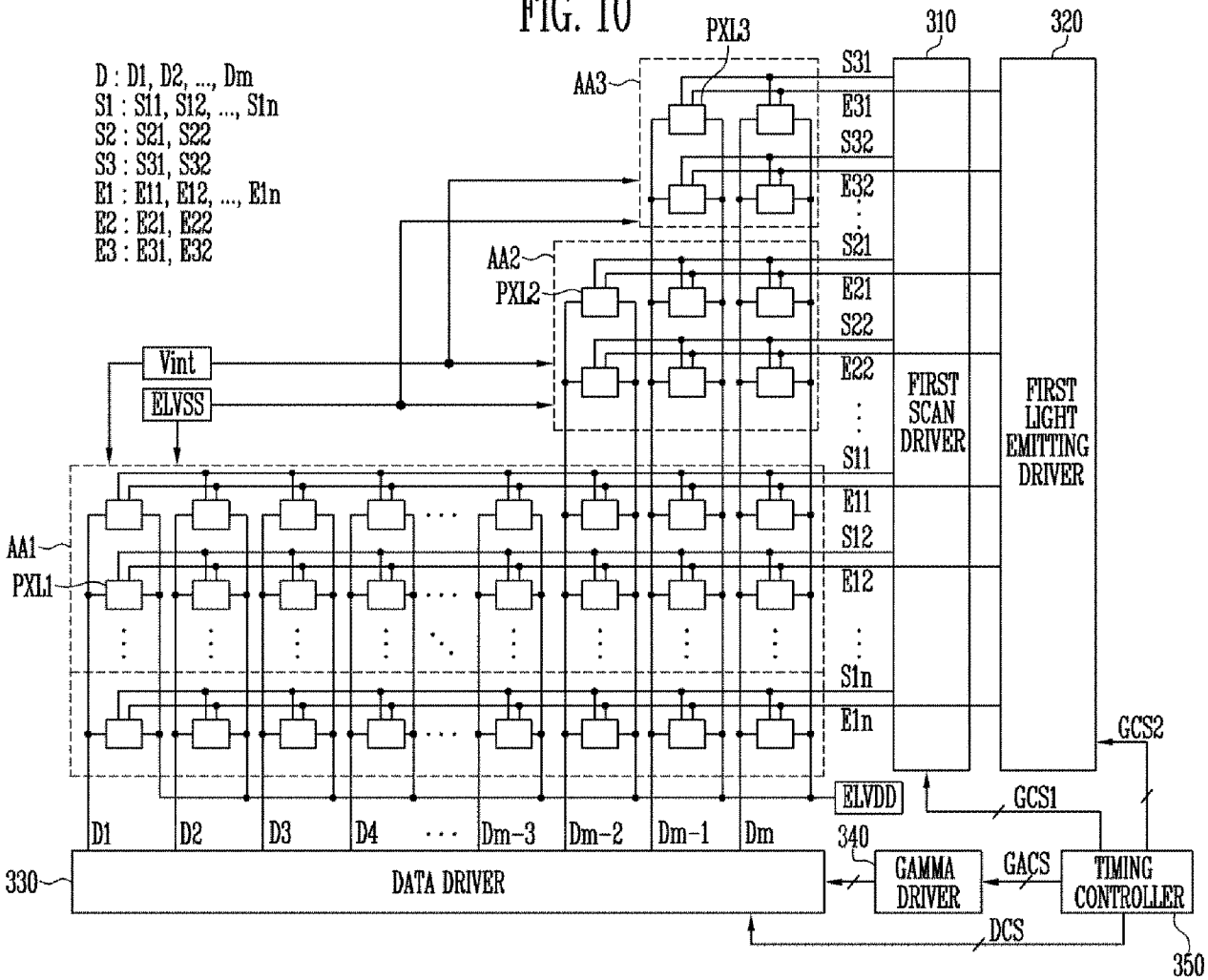
FIG. 10 is a diagram illustrating an embodiment of an organic light emitting display device corresponding to a substrate shown in FIG. 2.

FIG. 10 is a diagram illustrating an embodiment of an organic light emitting display device corresponding to a substrate shown in FIG. 2.

Referring to FIG. 10, an organic light emitting display device according to another embodiment may include a first scan driver 310, a first light-emitting driver 320, a data driver 330, a gamma driver 340, a timing controller 350, the first pixels PXL1, the second pixels PXL2 and the third pixels PXL3.

The first pixels PXL1 may be disposed in the first pixel area AA1 defined by the first scan lines S11 to S1*n*, the first light emission control lines E11 to E1*n* and the data lines D1 to Dm. The first pixels PXL1 may receive data signals from the data lines D1 to Dm when scan signals are supplied from the first scan lines S11 to S1*n*. The first pixels PXL1 receiving the data signals may control the amount of current flowing from the first power supply ELVDD via organic light emitting diodes to the second power supply ELVSS.

The second pixels PXL2 may be disposed in the second pixel area AA2 defined by the second scan lines S21 and S22, the second light emission control lines E21 and E22 and the data lines Dm-2 to Dm. The second pixels PXL2 may receive data signals from the data lines Dm-2 to Dm when scan signals are supplied to the second scan lines S21 and S22. The second pixels PXL2 receiving the data signals may control the amount of current flowing from the first power supply ELVDD via organic light emitting diodes to the second power supply ELVSS.

In addition, FIG. 10 illustrates six second pixels PXL2 are arranged in the second pixel area AA2 by two second scan lines S21 and S22, two second light emission control lines E21 and E22 and three data lines Dm-2 to Dm. However, the inventive concept is not limited thereto. In other words, the plurality of second pixels PXL2 may be arranged according to the size of the second pixel area AA2. The numbers of second scan lines S2, second light emission control lines E2 and data lines D may vary depending on a configuration of the second pixels PXL2, for example, numbers of the second scan lines, second light emission control lines and data lines in the second pixel area AA2.

The third pixels PXL3 may be disposed in the third pixel area AA3 defined by third scan lines S31 and S32, third light emission control lines E31 and E32 and data lines Dm-1 and Dm. The third pixels PXL3 may receive the data signals from the data lines Dm-1 and Dm when scan signals are supplied to the third scan lines S31 and S32. The third pixels PXL3 receiving the data signals may control the amount of current flowing from the first power supply ELVDD via organic light emitting diodes to the second power supply ELVSS.

In addition, FIG. 10 illustrates that four third pixels PXL3 are arranged in the third pixel area AA3 defined by the two third scan lines S31 and S32, the two third light emission control lines E31 and E32 and the two data lines Dm-1 and Dm. However, the inventive concept is not limited thereto. In other words, the plurality of third pixels PXL3 may be arranged according to the size of the third pixel area AA3. The numbers of third scan lines S3, third light emission control lines E3 and data lines D may vary depending on a configuration of the third pixels PXL3, for example, numbers of the second scan lines, second light emission control lines and data lines in the second pixel area AA3.

The first scan driver 310 may supply scan signals to the third scan lines S3, the second scan lines S2 and the first scan lines S1 in response to the first gate control signal GCS1 from the timing controller 350. For example, the first scan driver 310 may sequentially supply the scan signals to the third scan lines S3, the second scan lines S2 and the first scan lines S1. When the scan signals are sequentially supplied to the third scan lines S3, the second scan lines S2 and the first scan lines S1, the third pixels PXL3, the second pixels PXL2 and the first pixels PXL1 may be sequentially selected in a unit of horizontal scan line.

The first scan driver 310 may be formed onto the substrate 101 by a thin film process. In addition, the first scan driver 310 may be formed at both sides of the substrate 101 while interposing the first pixel area AA1, the second pixel area AA2 and the third pixel area AA3. In addition, the first pixel area AA1, the second pixel area AA2 and/or the third pixel area AA3 may be driven by different scan drivers.

The first light-emitting driver 320 may supply light emission control signals to the third light emission control lines E3, the second light emission control lines E2 and the first light emission control lines E1 in response to the second gate control signal GCS2 from the timing controller 350. For example, the first light-emitting driver 320 may sequentially supply the light emission control signals to the third light emission control lines E3, the second light emission control lines E2 and the first light emission control lines E1.

The first light-emitting driver 320 may be formed on the substrate 101 by a thin film process. In addition, the first light-emitting driver 320 may be formed at both sides of the substrate 101 while interposing the first pixel area AA1, the second pixel area AA2 and the third pixel area AA3. In addition, the first pixel area AA1, the second pixel area AA2 and the third pixel area AA3 may be driven by different light-emitting drivers.

The data driver 330 may supply data signals to the data lines D1 to Dm in response to the data control signal DCS from the timing controller 350. The data signals supplied to the data lines D1 to Dm may be supplied to the pixels PXL1, PXL2, and PXL3 selected by the scan signals. Although FIG. 10 illustrates that the data driver 330 is disposed at a bottom of the first pixel area AA1, the inventive concept is not limited thereto. For example, the data driver 330 may be disposed at a top of the first pixel area AA1.

The data driver 330 may supply data signals having different voltages except for the lowest grayscale, e.g., a black grayscale to the first pixels PXL1, the second pixels PXL2 and the third pixels PXL3 in response to the same grayscale so as to compensate for the brightness difference in the first pixels PXL1, the second pixels PXL2 and the third pixels PXL3 which receive data signals having the same grayscales.

More specifically, the first pixels PXL1 may be disposed in the first pixel area AA1 having the first width W1, the second pixels PXL2 may be disposed in the second pixel area AA2 having the second width W2, and the third pixels PXL3 may be disposed in the third pixel area AA3 having the third width W3.

Therefore, the first scan lines S1 disposed in the first pixel area AA1, the second scan lines S2 disposed in the second pixel area AA2, and the third scan lines S3 disposed in the third pixel area AA3 may have different RC loads.

Therefore, when the data signals of the same voltage are supplied, a first voltage may be stored in the first pixels PXL1, a second voltage higher than the first voltage may be stored in the second pixels PXL2, and a third voltage higher than the second voltage may be stored in the third pixels PXL3. Even when the data signals of the same grayscale are supplied, a brightness difference may occur in the first pixel area AA1, the second pixel area AA2 and the third pixel area AA3. For example, when the pixels PXL1, PXL2 and PXL3 are PMOS pixels, a darker screen may be displayed on the second pixel area AA2 than the first pixel area AA1, and a darker screen may be displayed on the third pixel area AA3 than the second pixel area AA2 in response to the data signals of the same grayscale.

To compensate for the brightness difference, the data driver 330 may supply data signals of different voltages to the first, second and third pixels PXL1, PXL2 and PXL3 in response to the same grayscale except for the lowest grayscale, e.g., a black grayscale. In other words, the data driver 330 may supply data signals having a lower voltage than the first pixels PXL1 to the second pixels PXL2 in response to the same grayscale except for the lowest grayscale, e.g., a black grayscale. Similarly, the data driver 330 may supply the data signals having a lower voltage than the second pixels PXL2 to the third pixels PXL3 in response to the same grayscale except for the lowest grayscale, e.g., a black grayscale. In response to the same grayscale, brightness of the second pixels PXL2 may be increased by first brightness, and brightness of the third pixels PXL3 may be increased by second brightness greater than the first brightness, so that the brightness difference between the first to third pixel areas AA1 to AA3 may be compensated.

In addition, by considering the widths of the second pixel area AA2 and the third pixel area AA3, the voltages of the data signals supplied to the second pixels PXL2 and the third pixels PXL3 may be experimentally determined so as not to cause a brightness difference between the second and third pixel areas AA2 and AA3 and the first pixels PXL1.

The gamma driver 340 may supply gamma voltages to the data driver 330 in response to the gamma control signals GACS from the timing controller 350.

The gamma driver 340 may supply different gamma voltages to the first to third pixels PXL1 to PXL3 so as to compensate for the brightness difference in response to the same grayscale except for the lowest grayscale, e.g., a black grayscale. For example, the gamma driver 340 may supply first gamma voltages to the first pixels PXL1, second gamma voltages lower than the first gamma voltages to the second pixels PXL2, and third gamma voltages lower than the second gamma voltages to the third pixels PXL3 in response to the same grayscale except for the lowest grayscale, e.g., a black grayscale.

The timing controller 350 may supply the first gate control signals GCS1 generated based on externally supplied timing signals to the first scan driver 310, the second gate control signals GCS2 to the first light-emitting driver 320, the gamma control signals GACS to the gamma driver 340, and the data control signals DCS to the data driver 330.

Figure 11:
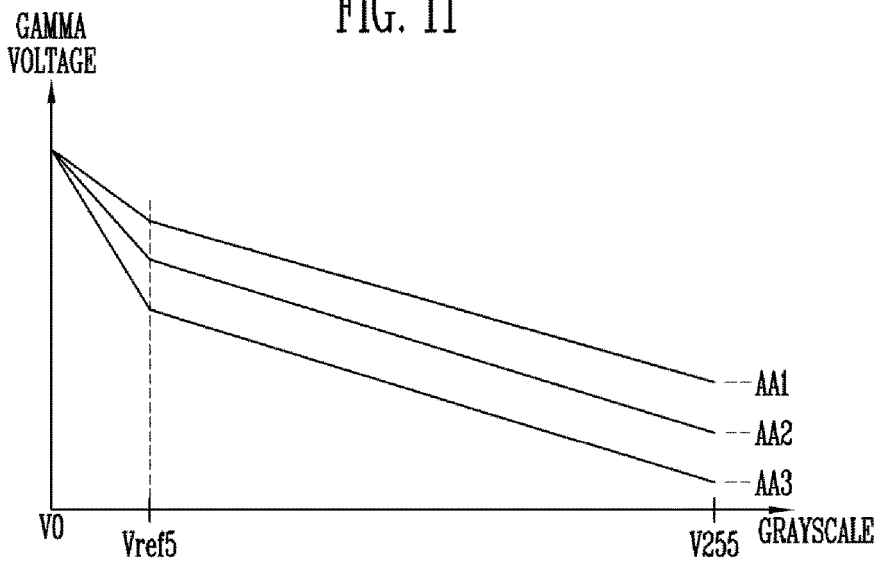
FIG. 11 is a view illustrating an embodiment of gamma voltages supplied to each of the pixel areas shown in FIG. 10.

FIG. 11 is a view illustrating an embodiment of gamma voltages supplied according to the pixel areas shown in FIG. 10. For convenience of explanation, it is assumed that an organic light emitting display device is driven by 256 levels of grayscale.

Referring to FIG. 11, the gamma driver 340 may supply 256 gamma voltages V0 to V255 to the data driver 330 in response to the 256 levels of grayscale.

The gamma voltages supplied to the first pixels PXL1 (i.e., first pixel area AA1) in response to the same grayscale may be set to be greater than gamma voltages supplied to the second pixels PXL2 (i.e., second pixel area AA2) except for the lowest grayscale, e.g., a black grayscale (V0). Similarly, the gamma voltages supplied to the second pixels PXL2 (i.e., second pixel area AA2) in response to the same grayscale may be set to be greater than the gamma voltages supplied to the third pixels PXL3 (i.e., third pixel area AA3) except for the lowest grayscale, e.g., a black grayscale (V0).

The brightness difference between the first to third pixel areas AA1 to AA3 may be compensated to display an image with uniform brightness for the same grayscale.

The gamma voltage V0 corresponding to black may be set to be the same regardless of the pixel areas AA1 to AA3. The data signals corresponding to black supplied from the data driver 330 may be set to have the same voltage supplied to the first to third pixels PXL1 to PXL3.

Figure 12:
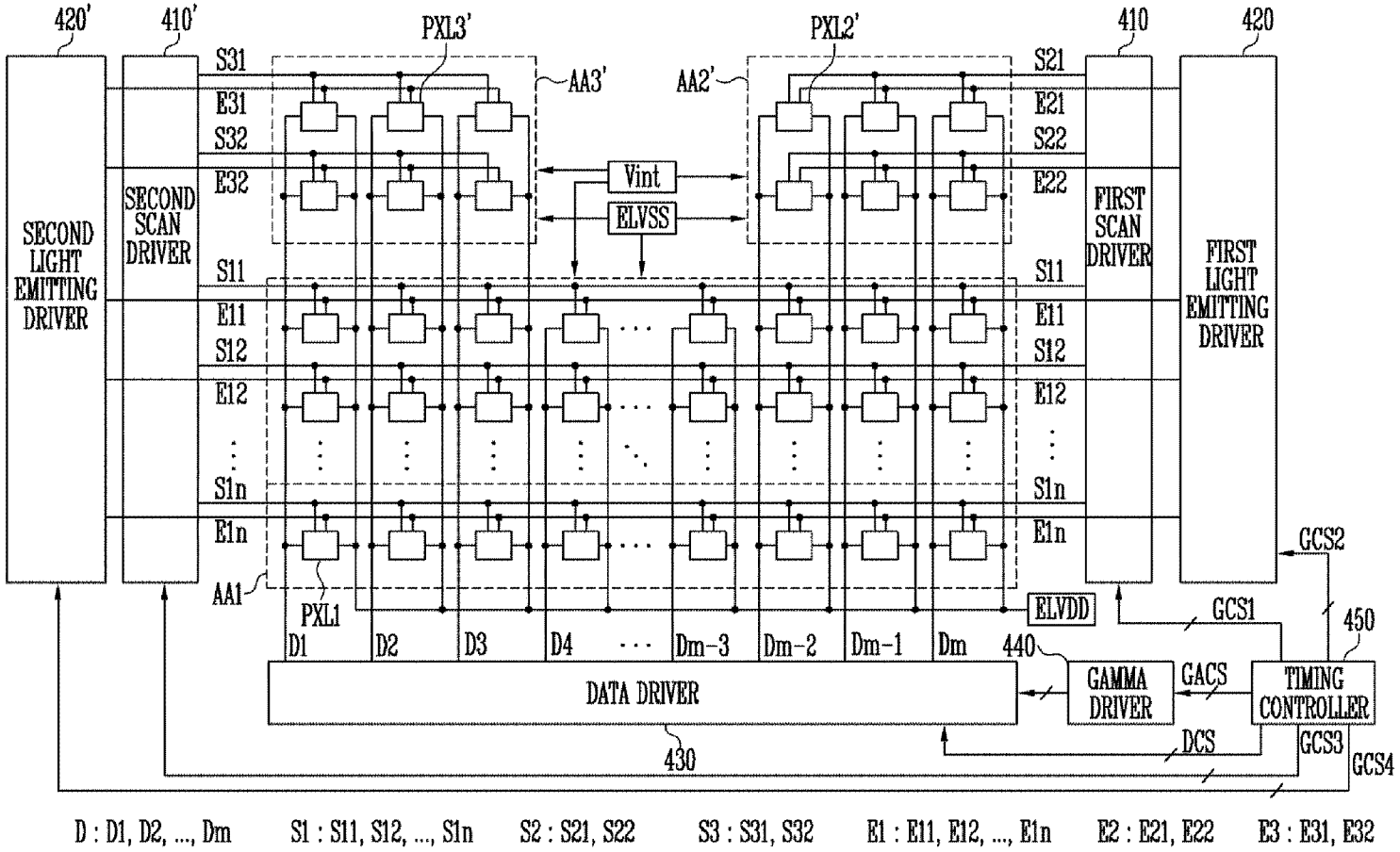
FIG. 12 is a diagram illustrating an embodiment of an organic light emitting display device corresponding to a substrate shown in FIG. 3.

FIG. 12 is a diagram illustrating an embodiment of an organic light emitting display device corresponding to a substrate shown in FIG. 3.

Referring to FIG. 12, an organic light emitting display device according to another embodiment may include a first scan driver 410, a first light-emitting driver 420, a second scan driver 410', a second light-emitting driver 420', a data driver 430, a gamma driver 440, a timing controller 450, the first pixels PXL1, the second pixels PXL2' and the third pixels PXL3'.

The first pixels PXL1 may be disposed in the first pixel area AA1 defined by the first scan lines S11 to S1*n*, the first light emission control lines E11 to E1*n* and the data lines D1 to Dm. The first pixels PXL1 may receive data signals from the data lines D1 to Dm when receiving scan signals from the first scan lines S11 to S1*n*. The first pixels PXL1 receiving the data signals may control the amount of current flowing from the first power supply ELVDD via organic light emitting diodes to the second power supply ELVSS.

The second pixels PXL2' may be disposed in the second pixel area AA2' defined by the second scan lines S21 and S22, the second light emission control lines E21 and E22 and the data lines Dm-2 to Dm. The second pixels PXL2' may receive data signals from the data lines Dm-2 to Dm when scan signals are supplied to the second scan lines S21 and S22. The second pixels PXL2' receiving the data signals may control the amount of current flowing from the first power supply ELVDD via organic light emitting diodes to the second power supply ELVSS. The number of second pixels PXL2' arranged according to the size of the second pixel area AA2' may vary. The numbers of second scan lines S2, second light emission control lines E2 and data lines D may vary depending on a configuration of the second pixels PXL2'.

The third pixels PXL3' may be disposed in the third pixel area AA3' defined by the third scan lines S31 and S32, the third light emission control lines E31 and E32 and data lines D1 to D3. The third pixels PXL3' may receive data signals from the data lines D1 to D3 when scan signals are supplied to the third scan lines S31 and S32. The third pixels PXL3' receiving the data signals may control the amount of current flowing from the first power supply ELVDD via the organic light emitting diodes to the second power supply ELVSS. The number of third pixels PXL3' arranged according to the size of the third pixel area AA3' may vary. The numbers of third scan lines S3, third light emission control lines E3 and data lines D may vary depending on a configuration of the third pixels PXL3'.

The first scan driver 410 may supply scan signals to the second scan lines S2 and the first scan lines S1 in response to the first gate control signal GCS1 from the timing controller 450. For example, the first scan driver 410 may sequentially supply the scan signals to the second scan lines S2 and the first scan lines S1. When the scan signals are supplied to the second scan lines S2 and the first scan lines S1, the second pixels PXL2' and the first pixels PXL1 may be sequentially selected in a unit of a horizontal line.

As illustrated in FIG. 12, the second pixel area AA2' and the first pixel area AA1 may be driven by the same first scan driver 410. However, the inventive concept is not limited thereto. For example, the second pixel area AA2' and the first pixel area AA1 may be driven by different scan drivers.

The first light-emitting driver 420 may supply light emission control signals to the second light emission control lines E2 and the first light emission control lines E1 in response to the second gate control signal GCS2 from the timing controller 450. For example, the first light-emitting driver 420 may sequentially supply the light emission control signals to the second light emission control lines E2 and the first light emission control lines E1.

As illustrated in FIG. 12, the second pixel area AA2' and the first pixel area AA1 may be driven by the same first light-emitting driver 420. However, the inventive concept is not limited thereto. For example, the second pixel area AA2' and the first pixel area AA1 may be driven by different light-emitting drivers.

The second scan driver 410' may supply scan signals to the third scan lines S3 and the first scan lines S1 in response to a third gate control signal GCS3 from the timing controller 450. For example, the second scan driver 410' may sequentially supply the scan signals to the third scan lines S3 and the first scan lines S1. When the scan signals are sequentially supplied to the third scan lines S3 and the first scan lines S1, the third pixels PXL3' and the first pixels PXL1 may be sequentially selected in a unit of a horizontal line.

As illustrated in FIG. 12, the third pixel area AA3' and the first pixel area AA1 may be driven by the same second scan driver 410'. However, the inventive concept is not limited thereto. For example, the third pixel area AA3' and the first pixel area AA1 may be driven by different scan drivers.

The second light-emitting driver 420' may supply light emission control signals to the third light emission control lines E3 and the first light emission control lines E1 in response to a fourth gate control signal GCS4 from the timing controller 450. For example, the second light-emitting driver 420' may sequentially supply the light emission control signals to the third light emission control lines E3 and the first light emission control lines E1.

FIG. 12 illustrates that the third pixel area AA3' and the first pixel area AA1 are driven by the same light-emitting driver 420'. However, the inventive concept is not limited thereto. For example, the third pixel area AA3' and the first pixel area AA1 may be driven by different light-emitting drivers.

The data driver 430 may supply data signals to the data lines D1 to Dm in response to the data control signal DCS from the timing controller 450. The data signals supplied to the data lines D1 to Dm may be supplied to the pixels PXL1, PXL2', and PXL3' selected by the scan signals. As illustrated in FIG. 12, the data driver 430 may be disposed at a bottom of the first pixel area AA1. However, the inventive concept is not limited thereto. For example, the data driver 430 may be disposed at a top of the first pixel area AA1.

The data driver 430 may set the data signals supplied to the second and third pixels PXL2' and PXL3' and the data signals supplied to the first pixels PXL1 to have different voltages so as to compensate for the brightness difference in response to the same grayscale except for the lowest grayscale, e.g., a black grayscale.

More specifically, the first pixels PXL1 disposed in the first pixel area AA1 may have the first width W1, the second pixels PXL2' disposed in the second pixel area AA2' may have the fourth width W4, and the third pixels PXL3' disposed in the third pixel area AA3' may have the fifth width W5. Hereinafter, for convenience of explanation, it is assumed that the fourth width W4 and the fifth width W5 are the same as each other. However, the fourth width W4 and the fifth width W5 may have difference widths.

An RC load of the first scan lines S1 disposed in the first pixel area AA1 having the first width W1 may be different from an RC load of the second scan lines S2 (or third scan lines S3) disposed in the second pixel area AA2' (or third pixel area AA3') having the fourth width W4 (or fifth width W5).

The data driver 430 may supply the first pixels PXL1 with data signals having different voltages from the data signals supplied to the second pixels PXL2' and the third pixels PXL3' in response to the same grayscale so as to compensate for the brightness difference corresponding to the RC loads. In other words, the data driver 430 may supply the data signals having a lower voltage than the first pixels PXL1 to the second pixels PXL2' in response to the same grayscale except for the lowest grayscale, e.g., a black grayscale. In the same manner, the data driver 430 may supply the data signals having a lower voltage than the first pixels PXL1 to the third pixels PXL3' in response to the same grayscale except for the lowest grayscale, e.g., a black grayscale. Since the fourth width W4 and the fifth width W5 are set to be the same as each other, the data signals supplied to the second pixels PXL2' and the third pixels PXL3' may be set to the same voltage in response to the same grayscale except for the lowest grayscale, e.g., a black grayscale.

As described above, when the data signals are supplied, the brightness of each of the second pixels PXL2' and the third pixels PXL3' may increase in response to the same grayscale except for the lowest grayscale, e.g., a black grayscale, and the brightness difference between the second and third pixels PXL2' and PXL3' and the first pixels PXL1 may be minimized.

When the fourth width W4 and the fifth width W5 are set to be different from each other, the first light-emitting data driver 420 may supply data signals having different voltages to the second pixels PXL2' and the third pixels PXL3' in response to the same grayscale except for the lowest grayscale, e.g., a black grayscale. For example, when the fifth width W5 is set to be smaller than the fourth width W4, the first light-emitting data driver 420 may supply the third pixels PXL3' with data signals having a lower voltage than the second pixels PXL2' in response to the same grayscale except for the lowest grayscale, e.g., a black grayscale.

The gamma driver 440 may supply gamma voltages to the data driver 430 in response to the gamma control signals GACS from the timing controller 450.

The gamma driver 440 may supply different gamma voltages from the second pixel area AA2' and the third pixel area AA3' to the first pixel area AA1 so as to compensate for the brightness difference in response to the same grayscale except for the lowest grayscale, e.g., a black grayscale. For example, the gamma driver 440 may supply greater gamma voltages than the second pixel area AA2' and the third pixel area AA3' to the first pixel area AA1.

The timing controller 450 may supply the first gate control signals GCS1 generated based on externally supplied timing signals to the first scan driver 410, the second gate control signals GCS2 to the first light-emitting driver 420, the third gate control signals GCS3 to the second scan driver 410', the fourth gate control signals GCS4 to the second light-emitting driver 420', the gamma control signals GACS to the gamma driver 440, and the data control signals DCS to the data driver 430.

Figure 13:
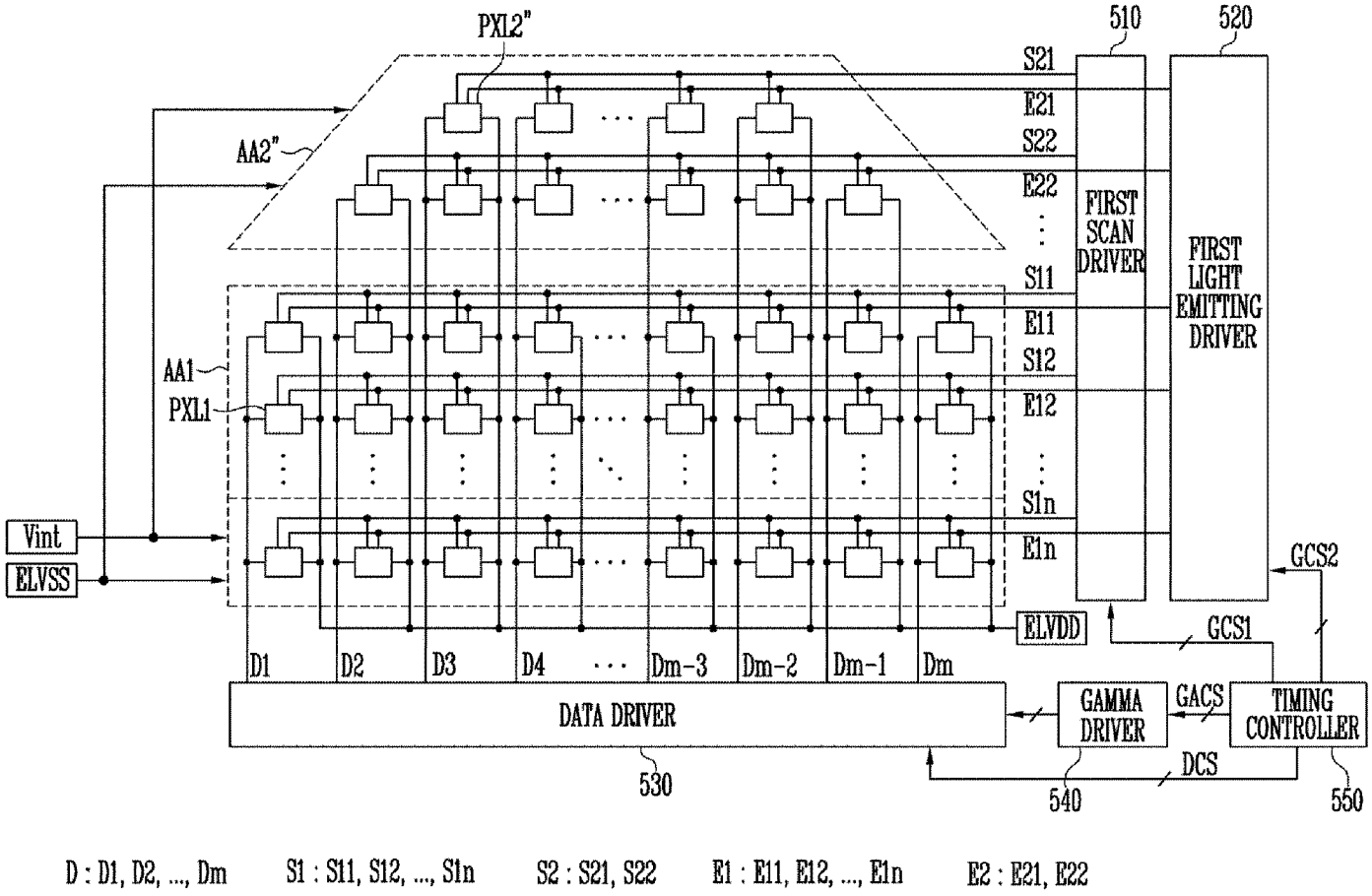
FIG. 13 is a diagram illustrating an embodiment of an organic light emitting display device corresponding to a substrate shown in FIG. 4.

FIG. 13 is a diagram illustrating an embodiment of an organic light emitting display device corresponding to a substrate shown in FIG. 4.

Referring to FIG. 13, the organic light emitting display device according to another embodiment may include a first scan driver 510, a first light-emitting driver 520, a data driver 530, a gamma driver 540, a timing controller 550, the first pixels PXL1 and the second pixels PXL2".

The first pixels PXL1 may be disposed in the first pixel area AA1 defined by the first scan lines S11 to S1*n*, the first light emission control lines E11 to E*n* and the data lines D1 to Dm. The first pixels PXL1 may receive data signals from the data lines D1 to Dm when scan signals are supplied from the first scan lines S11 to S1*n*. The first pixels PXL1 receiving the data signals may control the amount of current flowing from the first power supply ELVDD via organic light emitting diodes to the second power supply ELVSS.

The second pixels PXL2" may be disposed in the second pixel area AA2" defined by the second scan lines S21 and S22, the second light emission control lines E21 and E22 and the data lines D2 to Dm-1. The second pixels PXL2" may receive data signals from the data lines D2 to Dm-1 when scan signals are supplied to the second scan lines S21 and S22. The second pixels PXL2" receiving the data signals may control the amount of current flowing from the first power supply ELVDD via organic light emitting diodes to the second power supply ELVSS.

The second pixel area AA2" may be set to gradually decrease from the first width W1 to the sixth width W6. Therefore, the number of second pixels PXL2" arranged in each of a horizontal line may vary. In the second pixel area AA2", loads of the second scan lines S2 may vary in a unit of a horizontal line. As a result, a brightness difference may occur in the unit of a horizontal line.

Figure 14:
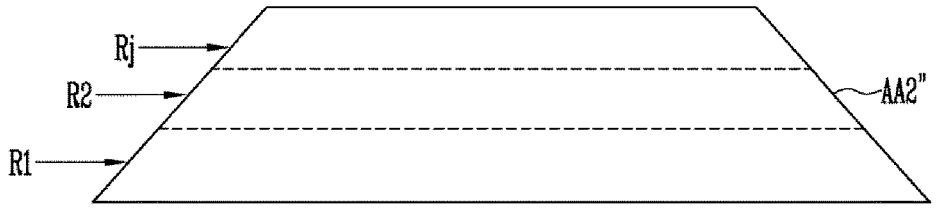
FIG. 14 is a view illustrating an embodiment illustrating a second pixel region shown in FIG. 13.

To prevent the brightness difference in a unit of a horizontal line, according to an embodiment, the second pixel area AA2" may include j regions R1, . . . , Rj including at least one horizontal line as shown in FIG. 14, where j is a natural number of 2 or more.

The first scan driver 510 may supply scan signals to the second scan lines S2 and the first scan lines S1 in response to the first gate control signal GCS1 from the timing controller 550. For example, the first scan driver 510 may sequentially supply scan signals to the second scan lines S2 and the first scan lines S1. When the scan signals are sequentially supplied to the second scan lines S2 and the first scan lines S1, the second pixels PXL2" and the first pixels PXL1 may be sequentially selected in a unit of a horizontal line.

As illustrated in FIG. 13, the second pixel area AA2" and the first pixel area AA1 may be driven by the same first scan driver 510. However, the inventive concept is not limited thereto. For example, the second pixel area AA2" and the first pixel area AA1 may be driven by different scan drivers.

The first light-emitting driver 520 may supply light emission control signals to the second light emission control lines E2 and the first light emission control lines E1 in response to the second gate control signal GCS2 from the timing controller 550. For example, the first light-emitting driver 520 may sequentially supply the light emission control signals to the second light emission control lines E2 and the first light emission control lines E1.

As illustrated in FIG. 13, the second pixel area AA2" and the first pixel area AA1 may be driven by the same light-emitting driver 520. However, the inventive concept is not limited thereto. For example, the second pixel area AA2" and the first pixel area AA1 may be driven by different light-emitting drivers.

The data driver 530 may supply data signals to the data lines D1 to Dm in response to the data control signal DCS from the timing controller 550. The data signals to the data lines D1 to Dm may be supplied to the pixels PXL1 and PXL2" selected by the scan signals. Referring to FIG. 13, the data driver 530 may be disposed at a bottom of the first pixel area AA1. However, the inventive concept is not limited thereto. For example, the data driver 530 may be disposed at a top of the first pixel area AA1.

The data driver 530 may supply data signals having different voltages to the first pixel area AA1 and the second pixel area AA2" except for the lowest grayscale, e.g., a black grayscale, in response to the same grayscale so as to compensate for the brightness difference. For example, the data driver 530 may supply the second pixels PXL2" with the data signals having a lower voltage than the data signals supplied to the first pixels PXL1 in response to the same grayscale except for the lowest grayscale, e.g., a black grayscale.

In addition, the data driver 530 may supply data signals having different voltages to the respective j regions R1, . . . , Rj included in the second pixel area AA2" in response to the same grayscale except for the lowest grayscale, e.g., a black grayscale. For example, the data driver 530 may supply a data signal having a lower voltage to a narrower area in response to the same grayscale in the j regions R1, . . . , Rj. As described above, when the data signals are supplied, the brightness difference between the first pixel area AA1 and the second pixel area AA2" and the brightness difference between j regions R1, . . . , Rj in the second pixel area AA2" may be compensated to display an image with uniform brightness.

The gamma driver 540 may supply gamma voltages to the data driver 530 in response to the gamma control signals GACS from the timing controller 550.

The gamma driver 540 may supply different gamma voltages to the first pixel area AA1 and the second pixel area AA2" to compensate for the brightness difference. For example, the gamma driver 540 may supply lower gamma voltages than the first pixel area AA1 to the second pixel area AA2".

Figure 15:
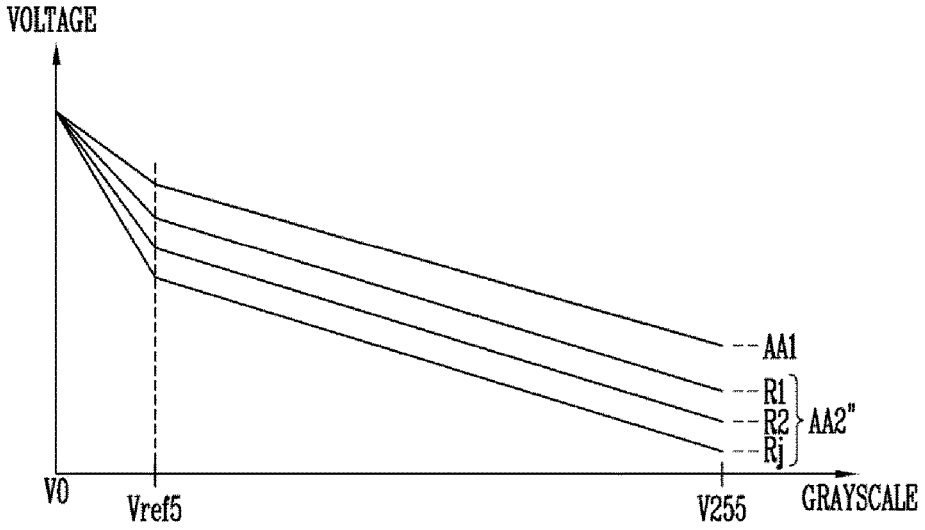
FIG. 15 is a view illustrating an embodiment of gamma voltages supplied to regions shown in FIG. 14.

In addition, the gamma driver 540 may supply different gamma voltages to the respective j regions R1, . . . , Rj included in the second pixel area AA2". For example, as illustrated in FIG. 15, the gamma driver 540 may supply lower gamma voltages to a narrower region in the j regions R1, . . . , Rj. As described above, when the gamma voltages are supplied, the voltages of the data signals supplied from the data driver 530 may be changed according to the pixel areas (AA1 and AA2") and the regions (R1, . . . , Rj) to display an image of uniform brightness.

The timing controller 550 may supply the first gate control signals GCS1 generated on the basis of externally supplied timing signals to the first scan driver 510, the second gate control signals GCS2 to the first light-emitting driver 520, the gamma control signals GACS to the gamma driver 540, and the data control signals DCS to the data driver 530.

Figure 16:
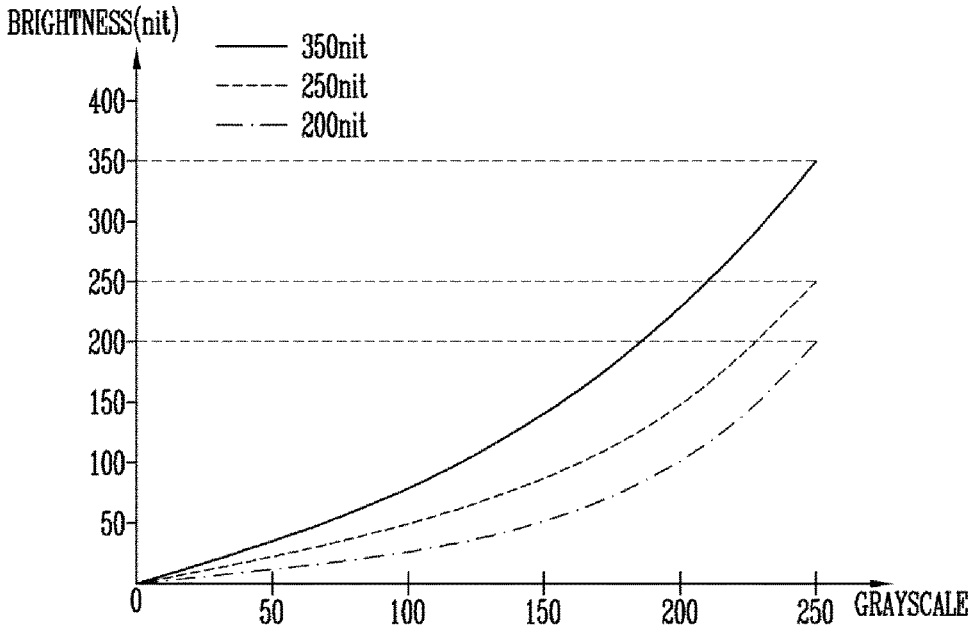
FIG. 16 is a view illustrating maximum brightness corresponding to dimming.

FIG. 16 is a view illustrating the maximum brightness corresponding to dimming.

Referring to FIG. 16, an organic light emitting display device according to an embodiment may apply dimming in order to minimize power consumption. Dimming refers to the technology for reducing power consumption by limiting the maximum brightness of a panel.

For example, dimming may include a plurality of dimming levels, and the maximum brightness may be changed to 350 nit, 250 nit, 200 nit . . . in response to the dimming levels. According to an embodiment, dimming may be implemented by currently known methods.

However, according to an embodiment, as described above, data signals supplied to pixels may have the same or different voltages in response to the respective dimming levels. Hereinafter, for convenience of explanation, a description will be made with reference to FIG. 5.

First, the maximum brightness may be limited in response to the dimming level. In this example, the data driver 230 may reduce the voltages of the data signals supplied to the first pixels PXL1 and the second pixels PXL2 by the same first voltage in response to the dimming level. In addition, the data driver 230 may reduce the voltages of the data signals supplied to the first pixels PXL1 by the first voltage in response to the dimming level, and reduce the data signals supplied to the second pixels PXL2 by a second voltage different from the first voltage.

The first voltage and the second voltage may be experimentally determined according to the shape and resolution of a panel to which the organic light emitting display device is applied, and types (e.g., PMOS or NMOS) of transistors forming pixels.

Figure 17:
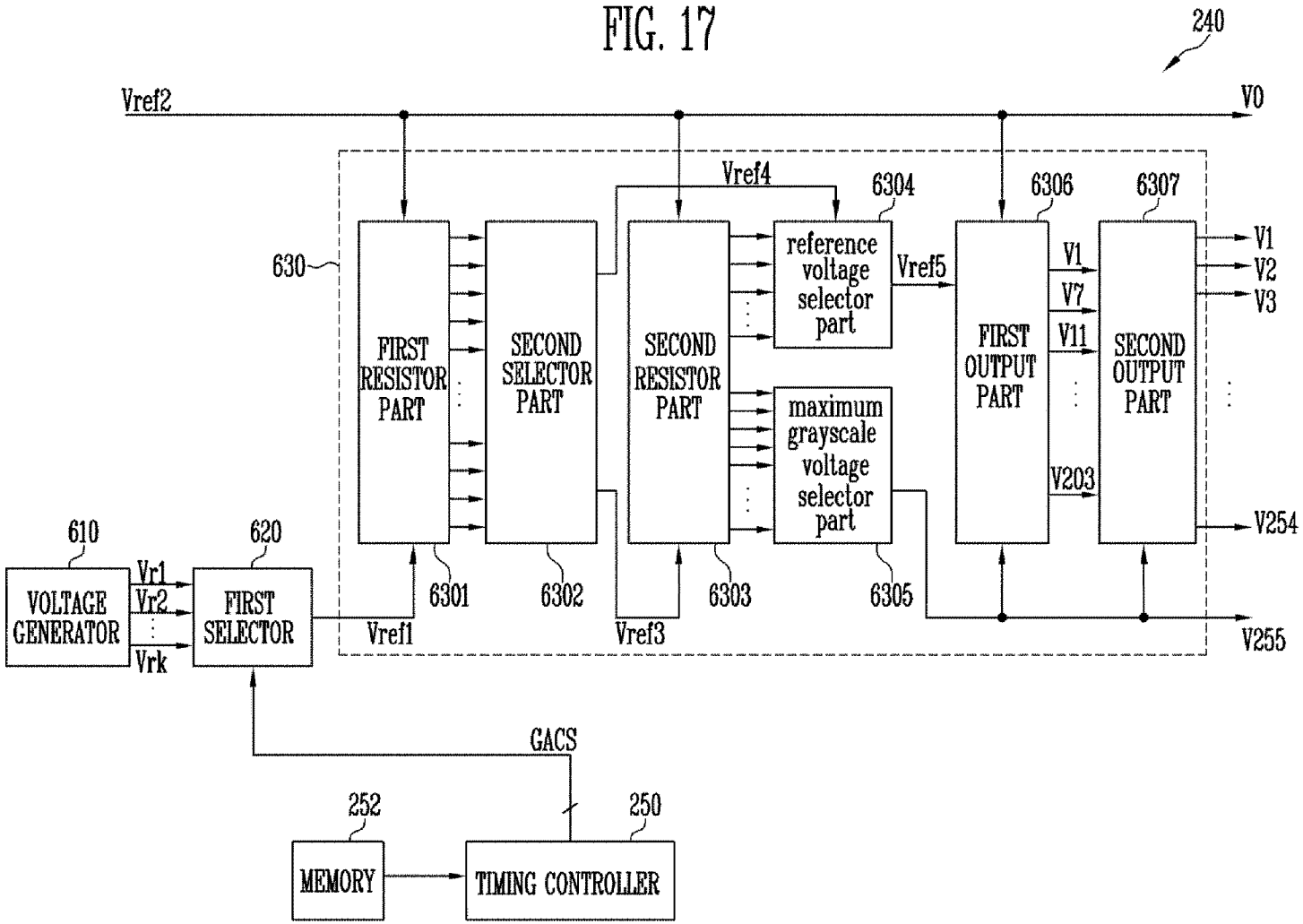
FIG. 17 is a diagram illustrating a gamma driver according to an embodiment.

FIG. 17 is a diagram illustrating the gamma driver 240 according to an embodiment. For convenience of explanation, in FIG. 17, operations will be described using the gamma driver shown in FIG. 5. In addition, in FIG. 17, it is assumed that the organic light emitting display device displays 256 levels of grayscale.

Referring to FIG. 17, the gamma driver 240 according to an embodiment may include a voltage generator 610, a first selector 620 and a grayscale voltage generator 630. The voltage generator 610 may generate a plurality of reference voltages Vr1 to Vrk, wherein k is a natural number of 2 or more. The first selector 620 may select one of the reference voltages Vr1 to Vrk as a first reference voltage Vref1. The grayscale voltage generator 630 may generate gamma voltages V1, V2, . . . , V255 by using the first reference voltage Vref1 and a second reference voltage Vref2.

The voltage generator 610 may generate the plurality of reference voltages Vr1 to Vrk. For example, the voltage generator 610 may generate two reference voltages corresponding to the first pixel area AA1 and the second pixel area AA2, respectively. The reference voltages Vr1 to Vrk may be applied to generate the maximum grayscale voltage V255. The maximum grayscale voltage V255 may be changed according to the selected reference voltage (one of Vr1 to Vrk) (i.e., Vref1).

The first selector 620 may select one of the reference voltages Vr1 to Vrk as the first reference voltage Vref1 in response to the gamma control signal GACS from the timing controller 250. For example, the first selector 620 may select the voltage Vr1 as the first reference voltage Vref1 during a period in which a data signal to be applied to the first pixel area AA1 is generated, and select the Voltage Vrk as the first reference voltage Vref1 during a period in which a data signal to be applied to the second pixel area AA2 is generated. Voltage values of the voltage Vr1 and the voltage Vrk may be set such that the gamma voltages V1, V2, . . . , V255 lower than those of the first pixel area AA1 may be supplied to the second pixel area AA2.

The grayscale voltage generator 630 may generate the gamma voltages V1, V2, . . . , V255 by using the second reference voltage Vref2 and the first reference voltage Vref1 which are supplied externally. The first reference voltage Vref1 may be set to be lower than the second reference voltage Vref2.

The grayscale voltage generator 630 may include a first resistor part 6301, a second selector part 6302, a second resistor part 6303, a reference voltage selector part 6304, a maximum grayscale voltage selector part 6305, a first output part 6306, and a second output part 6307.

The first resistor part 6301 may divide the second reference voltage Vref2 and the first reference voltage Vref1 to generate first divided voltages. The first resistor part 6301 may include a plurality of voltage dividing resistors (not illustrated).

The second selector part 6302 may select a third reference voltage Vref3 and a fourth reference voltage Vref4, among the first divided voltages. The second selector part 6302 may include a plurality of multiplexers (not illustrated). In addition, the fourth reference voltage Vref4 may be set to be greater than the third reference voltage Vref3.

The second resistor part 6303 may generate second divided voltages by dividing the second reference voltage Vref2 and the third reference voltage Vref3. The second resistor part 6303 may include a plurality of voltage dividing resistors (not illustrated).

The maximum grayscale voltage selector part 6305 may select one of the second divided voltages as the maximum grayscale voltage V255. The maximum grayscale voltage V255 may be a voltage corresponding to a data signal of the highest grayscale, for example, a data signal of white.

The reference voltage selector part 6304 may select one of the remaining second divided voltages except for the selected one of the second divided voltages and the fourth reference voltage Vref4 as a fifth reference voltage Vref5. The reference voltage selector part 6304 may control the fifth reference voltage Vref5 in response to the pixel areas AA1 and AA2. For example, the reference voltage selector part 6304 may select a predetermined voltage as the fifth reference voltage Vref5 during a period in which a data signal supplied to the first pixel area AA1 is generated. In addition, the reference voltage selector part 6304 may select a voltage which is different from the predetermined voltage as the fifth reference voltage Vref5 during a period in which a data signal supplied to the second pixel area AA2 is generated. The reference voltage selector part 6304 may select the fifth reference voltage Vref5 so that the gamma voltages V1, V2, . . . , V255 lower than those of the first pixel area AA1 may be supplied to the second pixel area AA2.

The first output part 6306 may generate predetermined gamma voltages V1, V7, V11, . . . , V203 by using the second reference voltage Vref2, the maximum grayscale voltage V255, and the fifth reference voltage Vref5. The first output part 6306 may include a plurality of voltage dividing resistors and a plurality of multiplexers.

According to an embodiment, the predetermined gamma voltages V1, V7, V11, . . . , V203 may be controlled in response to the maximum grayscale voltage V255 corresponding to the first reference voltage Vref1 output from the first selector 620 and the fifth reference voltage Vref5 output from the reference voltage selector part 6304. As illustrated in FIG. 7, when the fifth reference voltage Vref5 and the maximum grayscale voltage V255 (i.e., a voltage corresponding to the first reference voltage Vref1) are changed so as to correspond to the pixel areas AA1 and AA2, the voltages of the data signals may be controlled.

In other words, when the voltage values of the fifth reference voltage Vref5 and the maximum grayscale voltage V255 are controlled, it may also controlled that the data signals having a lower voltage than those of the first pixel area AA1 may be supplied to the second pixel area AA2 in response to the same grayscale except for the lowest grayscale, e.g., a black grayscale.

The second output part 6307 may generate the remaining gamma voltages V2, V3, . . . , and V254, except for the predetermined gamma voltages (V1, V7, V11, . . . , V203), by dividing the predetermined gamma voltages V1, V7, V11, . . . , V203 and the maximum grayscale voltage V255. The gamma voltages V0 to V255 generated by the gamma driver 240 may be supplied to the data driver 230. The data driver 230 may generate data signals corresponding to the gamma voltages V0 to V255 and supply the generated data signals to the pixels PXL1 and PXL2.

In addition, the second reference voltage Vref2 may be supplied as the gamma voltage V0 corresponding to the first grayscale. Therefore, data signals corresponding to the first grayscale may be set to the same voltage regardless of the pixel areas AA1 and AA2.

The timing controller 250 may control the gamma driver 240 so that different gamma voltages V0 to V255 may be supplied to the respective pixel areas AA1 and AA2 by referring to a memory 252. The memory 252 may previously store gamma values corresponding to the respective pixel areas AA1 and AA2 and gamma values corresponding to dimming levels.

The operations shown in FIG. 17 are described with reference to FIG. 5. However, the inventive concept is not limited thereto. In other words, the gamma driver shown in FIG. 17 may be applicable to organic light emitting display devices according to various embodiments of the inventive concept.

In other words, the gamma driver may select the first reference voltage Vref1 and the fifth reference voltage Vref5 in response to the plurality of pixel areas, so that different gamma voltages V0 to V255 may be supplied to the plurality of pixel areas, respectively.

A display device and a driving method thereof according to an embodiment of the inventive concept may display an image with uniform brightness on a panel including a plurality of pixel areas having different widths. In other words, according to an embodiment, data signals having different voltages may be supplied to the plurality of pixel areas having the different widths in response to the same grayscale except for the lowest grayscale, e.g., a black grayscale, so that an image with uniform brightness may be displayed.

Although example embodiments are disclosed herein, these embodiments should not be construed to limit a scope of the inventive concept. Those of ordinary skill in the art would recognize that various changes in form and details may be made without departing from the spirit and scope.

What is claimed is:

1. A display device, comprising:

a panel including a plurality of pixel areas having different widths, numbers of pixels connected to signal lines having different widths being different from each other; and a data driver supplying data signals having different voltages to the plurality of pixel areas in response to a same grayscale, wherein the data driver supplies a data signal having a lower voltage to a pixel area having a smaller width than a pixel area having a greater width in response to the same grayscale.

2. The display device of claim 1, wherein the data driver supplies a data signal having a same voltage to the plurality of pixel areas in response to a minimum grayscale.

3. The display device of claim 1, wherein at least one predetermined pixel area, among the plurality of pixel areas, gradually decreases a width from a first width to a second width smaller than the first width.

4. The display device of claim 3, wherein the predetermined pixel area has a plurality of regions, each of the plurality of regions including at least one horizontal line, and the data driver supplies data signals having different voltages to the each of the plurality of regions, respectively, in response to the same grayscale.

5. The display device of claim 4, wherein the data driver supplies a data signal having a lower voltage to a region having a smaller width than a region having a greater width in response to the same grayscale.

6. A display device, comprising:

a panel including a plurality of pixel areas having different widths, numbers of pixels connected to signal lines having different widths being different from each other;

a data driver supplying data signals having different voltages to the plurality of pixel areas in response to a same grayscale; and a gamma driver supplying different gamma voltages in response to a gamma control signals so that the data signals having the different voltages are supplied to the plurality of pixel areas in response to the same grayscale, wherein the gamma driver comprises:

a voltage generator generating reference voltages;

a first selector selecting one of the reference voltages as a first reference voltage; and a grayscale voltage generator generating the gamma voltages by using the first reference voltage and a second reference voltage supplied externally, the second reference voltage corresponding to a black.

7. The display device of claim 6, wherein the first selector selects a different voltage, among the reference voltages, as the first reference voltage in each of the plurality of pixel areas.

8. The display device of claim 6, wherein the first reference voltage is set to be lower than the second reference voltage.

9. The display device of claim 6, wherein the grayscale voltage generator comprises:

a first resistor part generating first divided voltages by dividing the first reference voltage and the second reference voltage;

a second selector part selecting a third reference voltage and a fourth reference voltage, among the first divided voltages;

a second resistor part generating second divided voltages by dividing the second reference voltage and the third reference voltage;

a maximum grayscale voltage selector part selecting one of at least one voltage included in the second divided voltages as a maximum grayscale voltage;

a reference voltage selector part selecting one of the fourth reference voltage and remaining voltages, except for the at least one voltage, among the second divided voltages, as a fifth reference voltage;

a first output part generating predetermined gamma voltages by using the maximum grayscale voltage, the second reference voltage and the fifth reference voltage; and a second output part generating remaining gamma voltages, except for the predetermined gamma voltages, by using the predetermined gamma voltages and the maximum grayscale voltage.

10. The display device of claim 9, wherein the third reference voltage is set to be lower than the fourth reference voltage.

11. The display device of claim 9, wherein the reference voltage selector part selects a different voltage as the fifth reference voltage in each of the plurality of pixel areas.

12. A display device, comprising:

first pixels disposed in a first pixel area having a first width, a first number of pixels being connected to a signal line in the first pixel area;

second pixels having at least a portion disposed in a second pixel area having a second width smaller than the first width, a second number of pixels smaller than the first number of pixels being connected to a signal line in the second pixel area; and drivers driving the first pixels and the second pixels, wherein the drivers supply data signals having different voltages to the first pixels and the second pixels in response to a same grayscale, and wherein the drivers supply the second pixels with data signals having a lower voltage than the first pixels in response to the same grayscale.

13. The display device of claim 12, wherein the drivers supplies a data signal having a same voltage to the plurality of pixel areas in response to a minimum grayscale.

14. The display device of claim 12, further comprising third pixels disposed in a third pixel area having a third width different from the second width, a third number of pixels being connected to a signal line in the third pixel area.

15. The display device of claim 14, wherein the drivers supply the third pixels with data signals having different voltages from the first pixels and the second pixels in response to the same grayscale.

16. The display device of claim 14, wherein the third width is set to be smaller than the second width.

17. The display device of claim 16, wherein the drivers supply the third pixels with the data signals having a lower voltage than the second pixels in response to the same grayscale.

18. The display device of claim 12, further comprising third pixels spaced apart from the second pixel area and disposed in a third pixel area having a same width as the second width.

19. The display device of claim 18, wherein the drivers supply data signals having a same voltage to the second pixels and the third pixels in response to the same grayscale.

20. The display device of claim 12, wherein the second pixel area gradually decrease a width from the first width to the second width.

21. The display device of claim 20, wherein the second pixel area has a plurality of regions, each of the plurality of regions including at least one horizontal line, and the drivers supply data signals having different voltages to each of the plurality of regions, respectively, in response to the same grayscale.

22. The display device of claim 21, wherein the drivers supply a data signal having a lower voltage to a region having a smaller width than a region having a greater width in response to the same grayscale.

23. The display device of claim 12, wherein maximum brightness of each of the first pixels and the second pixels is limited in response to a plurality of dimming levels.

24. The display device of claim 23, wherein the drivers change voltages of data signals of a predetermined grayscale supplied to the first pixels and the second pixels by a first voltage in response to a predetermined dimming level.

25. The display device of claim 23, wherein the drivers change the voltages of the data signals of the predetermined grayscale supplied to the first pixels by the first voltage in response to the predetermined dimming level, and the voltages of the data signals of the predetermined grayscale supplied to the second pixels by a second voltage different from the first voltage.

26. The display device of claim 12, wherein the drivers comprise:

a gamma driver generating gamma voltages;

a data driver generating the data signals by using the gamma voltages and supplying the data signals to the first pixels and the second pixels; and a timing controller controlling the data driver and the gamma driver.

27. The display device of claim 26, further comprising a memory storing gamma values corresponding to the first pixel area and the second pixel area, and dimming levels.

28. The display device of claim 26, wherein the gamma driver supplies different gamma voltages to the first pixels and the second pixels in response to the same grayscale.

29. The display device of claim 28, wherein the gamma driver comprises:

a voltage generator generating reference voltages;

a first selector selecting one of the reference voltages as a first reference voltage; and a grayscale voltage generator generating the gamma voltages by using the first reference voltage and a second reference voltage supplied externally, the second reference voltage corresponding to a black.

30. The display device of claim 29, wherein the first selector selects a different voltage, among the reference voltages, as the first reference voltage in response to each of the first pixel area and the second pixel area.

31. The display device of claim 29, wherein the first reference voltage is set to be lower than the second reference voltage.

32. The display device of claim 29, wherein the grayscale voltage generator comprises:

a first resistor part generating first divided voltages by dividing the first reference voltage and the second reference voltage;

a second selector part selecting a third reference voltage and a fourth reference voltage, among the first divided voltages;

a second resistor part generating second divided voltages by dividing the second reference voltage and the third reference voltage;

a maximum grayscale voltage selector part selecting one of at least one divided voltage included in the second divided voltages as a maximum grayscale voltage;

a reference voltage selector part selecting one of the fourth reference voltage and remaining voltages, except the at least one divided voltage, among the second divided voltages, as a fifth reference voltage;

a first output part generating predetermined gamma voltages by using the maximum grayscale voltage, the second reference voltage and the fifth reference voltage; and a second output part generating remaining gamma voltages, except for the predetermined gamma voltages, by using the predetermined gamma voltages and the maximum grayscale voltage.

33. The display device of claim 32, wherein the third reference voltage is set to be lower than the fourth reference voltage.

34. The display device of claim 32, wherein the reference voltage selector part selects a different voltage as the fifth reference voltage in response to each of the first and second pixel areas.

35. A method of driving a display device having a panel including a plurality of pixel areas having different widths, numbers of pixels connected to signal lines having different widths being different from each other, the method comprising:

supplying data signals having different voltages to the plurality of pixel areas in response to a same grayscale, wherein the pixel areas includes a PMOS driving transistor, and wherein a data signal having a lower voltage is supplied to a pixel area having a smaller width than a pixel area having a greater width in response to the same grayscale.

36. The method of claim 35, further comprising:

supplying data signals having a same voltage to the plurality of pixel areas in response to a minimum grayscale.

37. A display device, comprising:

a display panel including two display areas, the two display areas including a first display area having a first gate line to which a first number of pixels are connected and a second display area having a second gate line to which a second number of pixels are connected; and a data driver supplying data signals having a first voltage to the first display area and a second voltage to the second display area in response to a same grayscale, wherein the first number is greater than the second number, wherein the display panel includes a PMOS driving transistor, and wherein the first voltage is higher than the second voltage.

38. The display device of claim 37, wherein the second gate line includes a plurality of second gate lines, wherein a number of pixels connected to a second gate line adjacent to the first display area is greater than a number of pixels connected to a second gate line farther from the first display area, and wherein, in response to the same grayscale, data signals applied to the pixels connected to the gate line adjacent to the first display area is higher than data signals applied to the pixels connected to the gate line farther from the first display area.

39. The display device of claim 37, further comprising a third display area having a third gate line to which a third number of pixels are connected, wherein the third number is smaller than the second number, and wherein, in response to the same grayscale, the data driver supplies a data signal having a third voltage lower than the second voltage to the third display area.

40. The display device of claim 37, wherein the second display area includes two second display areas, and wherein the two second display areas are disposed in opposite end of the first display area.

* * * * *